US010915048B2

(12) United States Patent
Adachi et al.

(10) Patent No.: US 10,915,048 B2
(45) Date of Patent: Feb. 9, 2021

(54) HEATER INCLUDING MULTIPLE HEATING ELEMENTS, AND FIXING DEVICE AND IMAGE FORMING APPARATUS INCLUDING THE HEATER

(71) Applicants: Tomoya Adachi, Kanagawa (JP); Yuusuke Furuichi, Kanagawa (JP); Yukimichi Someya, Saitama (JP)

(72) Inventors: Tomoya Adachi, Kanagawa (JP); Yuusuke Furuichi, Kanagawa (JP); Yukimichi Someya, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/269,616

(22) Filed: Feb. 7, 2019

(65) Prior Publication Data

US 2019/0278206 A1 Sep. 12, 2019

(30) Foreign Application Priority Data

Mar. 12, 2018 (JP) ..... 2018-044362
Dec. 20, 2018 (JP) ..... 2018-238734

(51) Int. Cl.
*G03G 15/20* (2006.01)
*G03G 15/00* (2006.01)

(52) U.S. Cl.
CPC ..... *G03G 15/2053* (2013.01); *G03G 15/2042* (2013.01); *G03G 15/5004* (2013.01)

(58) Field of Classification Search
USPC ..... 399/67
See application file for complete search history.

(56) References Cited

U.S. PATENT DOCUMENTS

2012/0308252 A1* 12/2012 Shimura ..... G03G 15/2039 399/67
2019/0041779 A1* 2/2019 Takagi ..... G03G 15/2039

FOREIGN PATENT DOCUMENTS

JP 2008-052488 3/2008
JP 2015-227917 12/2015
WO WO 2017/047531 A1 3/2017

OTHER PUBLICATIONS

Extended European Search Report dated Sep. 10, 2019 in European Patent Application No. 19154174.7, 8 pages.

* cited by examiner

*Primary Examiner* — Quana Grainger
(74) *Attorney, Agent, or Firm* — Oblon, McClelland, Maier & Neustadt, L.L.P.

(57) ABSTRACT

A heater includes a plurality of resistive heat generators electrically connected to each other in parallel. A power supply supplies power to the resistive heat generators. An electric current detector detects an electric current that flows through the resistive heat generators. A voltage detector detects a voltage applied to the resistive heat generators. An electric current controller controls the electric current that flows through the resistive heat generators based on the electric current detected by the electric current detector and the voltage detected by the voltage detector. The electric current detector detects the electric current in a state in which, after the power supply starts supplying the power to the resistive heat generators, a waveform of an alternating current supplied to the resistive heat generators remains constant for a predetermined time period or longer taken for the electric current detector to detect the electric current.

9 Claims, 16 Drawing Sheets

HEATER INCLUDING MULTIPLE HEATING ELEMENTS, AND FIXING DEVICE AND IMAGE FORMING APPARATUS INCLUDING THE HEATER

CROSS-REFERENCE TO RELATED APPLICATIONS

This patent application is based on and claims priority pursuant to 35 U.S.C. § 119(a) to Japanese Patent Application Nos. 2018-044362, filed on Mar. 12, 2018, and 2018-238734, filed on Dec. 20, 2018, in the Japan Patent Office, the entire disclosure of each of which is hereby incorporated by reference herein.

BACKGROUND

Technical Field

Exemplary aspects of the present disclosure relate to a heater, a fixing device, and an image forming apparatus, and more particularly, to a heater including a resistive heat generator, a fixing device incorporating the heater, and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses employ fixing devices of various types to fix the image on the recording medium. As one example, the fixing device includes a fixing belt that is thin and has a decreased thermal capacity and a laminated heater constructed of a base and a plurality of resistive heat generators. The laminated heater heats the fixing belt. The base of the laminated heater extends in an axial direction of the fixing belt. The plurality of resistive heat generators is disposed on the base and is electrically connected in parallel.

SUMMARY

This specification describes below an improved heater. In one embodiment, the heater includes a base and a plurality of resistive heat generators electrically connected to each other in parallel in a longitudinal direction of the base. A power supply supplies power to the resistive heat generators. An electric current detector detects an electric current that flows through the resistive heat generators. A voltage detector detects a voltage applied to the resistive heat generators. An electric current controller controls the electric current that flows through the resistive heat generators based on the electric current detected by the electric current detector and the voltage detected by the voltage detector. The electric current detector detects the electric current in a state in which, after the power supply starts supplying the power to the resistive heat generators, a waveform of an alternating current supplied to the resistive heat generators remains for a predetermined time period or longer taken for the electric current detector to detect the electric current.

This specification further describes an improved fixing device. In one embodiment, the fixing device includes a tubular belt that is rotatable and a pressure rotator that contacts the tubular belt. At least one of the tubular belt and the pressure rotator defines a fixing nip through which a recording medium bearing an image formed with a developer is conveyed. The fixing device further includes the heater described above that heats the tubular belt from which heat is conducted to the fixing nip.

This specification further describes an improved image forming apparatus. In one embodiment, the image forming apparatus includes an image forming device that forms an image with a developer. The image forming apparatus further includes the fixing device described above that fixes the image on a recording medium.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1A:
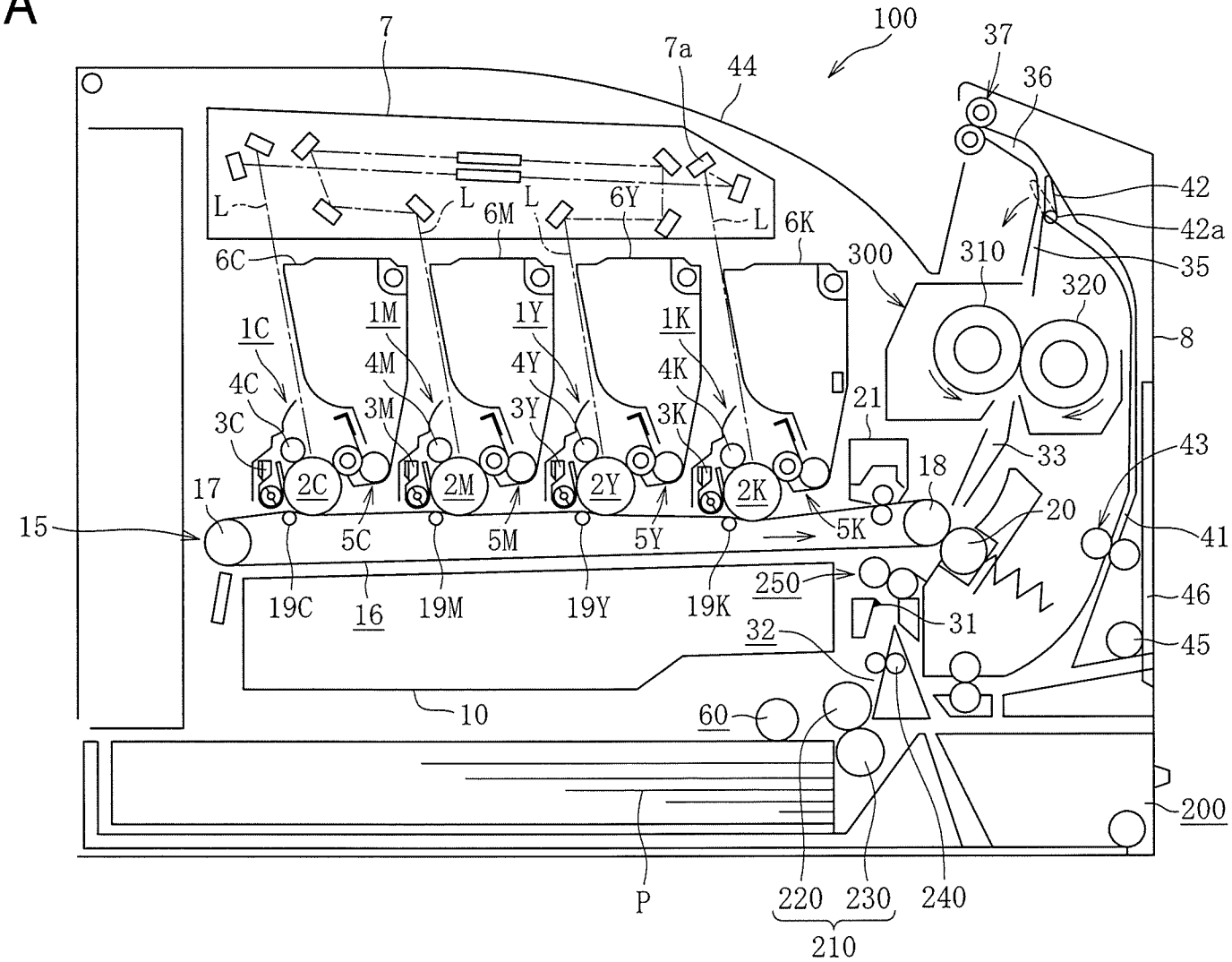
FIG. 1A is a schematic cross-sectional view of a laser printer according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, a laser printer 100 serving as an image forming apparatus is explained.

The image forming apparatus may be a copier, a facsimile machine, a printer, a multifunction peripheral or a multifunction printer (MFP) having at least two of copying, printing, scanning, facsimile, plotter, and other functions, or the like. According to this embodiment, the image forming apparatus is a color printer that forms color and monochrome toner images on a recording medium by electrophotography. Alternatively, the image forming apparatus may be a monochrome printer that forms a monochrome toner image on a recording medium.

Referring to drawings, a description is provided of a construction of a heater, a fixing device incorporating the heater, and an image forming apparatus (e.g., a laser printer) incorporating the fixing device according to embodiments of the present disclosure.

In the drawings, identical reference numerals are assigned to identical elements and equivalents and redundant descriptions of the identical elements and the equivalents are summarized or omitted properly. The dimension, material, shape, relative position, and the like of each of the elements are examples and do not limit the scope of this disclosure unless otherwise specified.

According to the embodiments below, a sheet is used as a recording medium.

However, the recording medium is not limited to paper as the sheet. In addition to paper as the sheet, the recording medium includes an OHP (overhead projector) transparency, cloth, a metal sheet, plastic film, and a prepreg sheet pre-impregnated with resin in carbon fiber.

The recording medium also includes a medium adhered with a developer and ink, recording paper, and a recording sheet. The sheet includes plain paper, thick paper, a postcard, an envelope, thin paper, coated paper, art paper, and tracing paper.

Image formation described below denotes forming an image having meaning such as characters and figures and an image not having meaning such as patterns on the medium.

A description is provided of a construction of the laser printer 100.

Figure 1B:
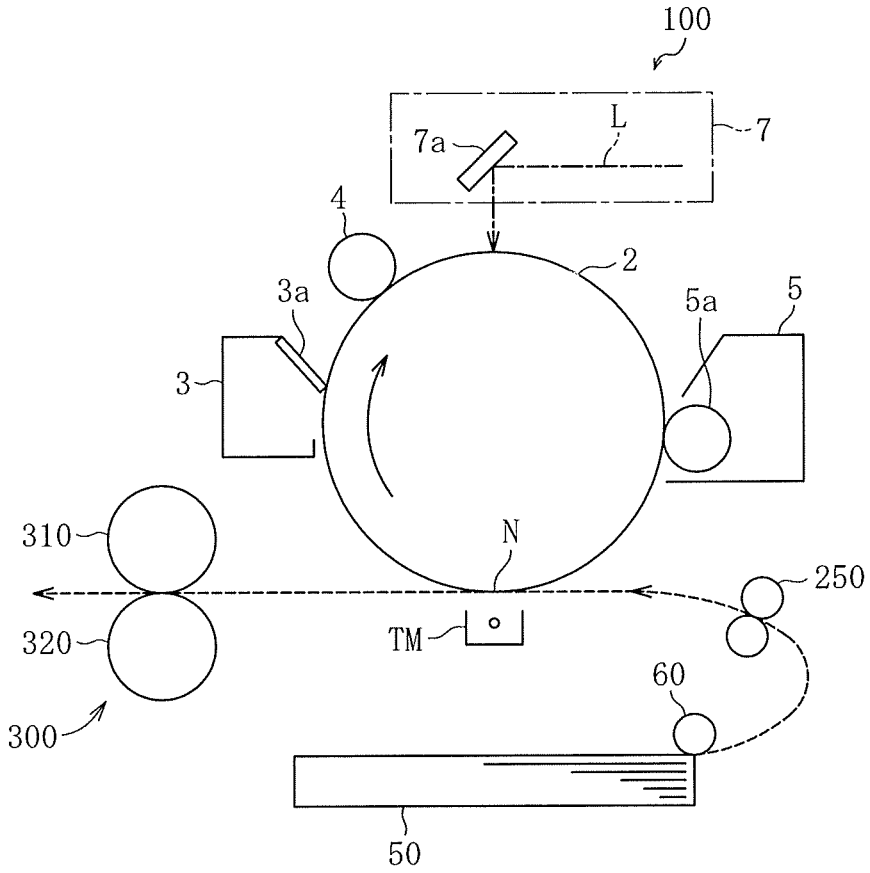
FIG. 1B is a schematic cross-sectional view of the laser printer depicted in FIG. 1A, illustrating and simplifying a principle or a mechanism of the laser printer.

FIG. 1A is a schematic cross-sectional view of the laser printer 100 according to an embodiment of the present disclosure. The laser printer 100 is a color laser printer serving as an image forming apparatus incorporating a heater or a fixing device 300. FIG. 1B is a schematic cross-sectional view of the laser printer 100, illustrating and simplifying a principle or a mechanism of the laser printer 100.

As illustrated in FIG. 1A, the laser printer 100 includes four process units 1K, 1Y, 1M, and 1C serving as an image forming device. The process units 1K, 1Y, 1M, and 1C form black, yellow, magenta, and cyan toner images with developers in black (K), yellow (Y), magenta (M), and cyan (C), respectively, which correspond to color separation components for a color image.

The process units 1K, 1Y, 1M, and 1C have a common construction except that the process units 1K, 1Y, 1M, and 1C include toner bottles 6K, 6Y, 6M, and 6C containing fresh toners in different colors, respectively. Hence, the following describes a construction of a single process unit, that is, the process unit 1K, and a description of a construction of each of other process units, that is, the process units 1Y, 1M, and 1C, is omitted.

The process unit 1K includes an image bearer 2K (e.g., a photoconductive drum), a drum cleaner 3K, and a discharger. The process unit 1K further includes a charger 4K and a developing device 5K. The charger 4K serves as a charging member or a charging device that uniformly charges a surface of the image bearer 2K. The developing device 5K serves as a developing member that develops an electrostatic latent image formed on the image bearer 2K into a visible image. The process unit 1K is detachably attached to a body of the laser printer 100 to replace consumables of the process unit 1K with new ones. Similarly, the process units 1Y, 1M, and 1C include image bearers 2Y, 2M, and 2C, drum cleaners 3Y, 3M, and 3C, chargers 4Y, 4M, and 4C, and developing devices 5Y, 5M, and 5C, respectively. In FIG. 1B, the image bearers 2K, 2Y, 2M, and 2C, the drum cleaners 3K, 3Y, 3M, and 3C, the chargers 4K, 4Y, 4M, and 4C, and the developing devices 5K, 5Y, 5M, and 5C are indicated as an image bearer 2, a drum cleaner 3, a charger 4, and a developing device 5, respectively.

An exposure device 7 is disposed above the process units 1K, 1Y, 1M, and 1C disposed inside the laser printer 100. The exposure device 7 performs scanning and writing according to image data. For example, the exposure device 7 includes a laser diode that emits a laser beam L according to the image data and a mirror 7*a* that reflects the laser beam L to the image bearer 2K so that the laser beam L irradiates the image bearer 2K.

According to this embodiment, a transfer device 15 is disposed below the process units 1K, 1Y, 1M, and 1C. The transfer device 15 is equivalent to a transferor TM depicted in FIG. 1B. Primary transfer rollers 19K, 19Y, 19M, and 19C are disposed opposite the image bearers 2K, 2Y, 2M, and 2C, respectively, and in contact with an intermediate transfer belt 16.

The intermediate transfer belt 16 rotates in a state in which the intermediate transfer belt 16 is looped over the primary transfer rollers 19K, 19Y, 19M, and 19C, a driving roller 18, and a driven roller 17. A secondary transfer roller 20 is disposed opposite the driving roller 18 and in contact with the intermediate transfer belt 16. The image bearers 2K, 2Y, 2M, and 2C serve as primary image bearers that bear black, yellow, magenta, and cyan toner images, respectively. The intermediate transfer belt 16 serves as a secondary image bearer that bears a composite toner image (e.g., a color toner image) formed with the black, yellow, magenta, and cyan toner images.

A belt cleaner 21 is disposed downstream from the secondary transfer roller 20 in a rotation direction of the intermediate transfer belt 16. A cleaning backup roller is disposed opposite the belt cleaner 21 via the intermediate transfer belt 16.

A sheet feeder 200 including a tray 50 depicted in FIG. 1B that loads sheets P is disposed in a lower portion of the laser printer 100. The sheet feeder 200 serves as a recording medium supply that contains a sheaf of sheets P serving as recording media. The sheet feeder 200 is combined with a sheet feeding roller 60 and a roller pair 210, serving as separation-conveyance members that separate an uppermost sheet P from other sheets P and convey the uppermost sheet P, into a unit. The sheet feeder 200 is inserted into and removed from the body of the laser printer 100 for replenishment of the sheets P and the like. The sheet feeding roller 60 and the roller pair 210 are disposed above the sheet feeder 200 and convey the uppermost sheet P of the sheaf of sheets P placed in the sheet feeder 200 toward a sheet feeding path 32.

A registration roller pair 250 serving as a conveyer is disposed immediately upstream from the secondary transfer roller 20 in a sheet conveyance direction. The registration roller pair 250 temporarily halts the sheet P sent from the sheet feeder 200. As the registration roller pair 250 temporarily halts the sheet P, the registration roller pair 250 slacks a leading end of the sheet P, correcting skew of the sheet P.

A registration sensor 31 is disposed immediately upstream from the registration roller pair 250 in the sheet conveyance direction. The registration sensor 31 detects passage of the leading end of the sheet P. When a predetermined time period elapses after the registration sensor 31 detects passage of the leading end of the sheet P, the sheet P strikes the registration roller pair 250 and halts temporarily.

Downstream from the sheet feeder 200 in the sheet conveyance direction is a conveying roller 240 that conveys the sheet P conveyed rightward from the roller pair 210 upward. As illustrated in FIG. 1A, the conveying roller 240 conveys the sheet P upward toward the registration roller pair 250.

The roller pair 210 is constructed of a pair of rollers, that is, an upper roller and a lower roller. The roller pair 210 employs a friction reverse roller (FRR) separation system or a friction roller (FR) separation system. According to the FRR separation system, a separating roller (e.g., a reverse roller) is applied with a torque in a predetermined amount in an anti-feeding direction by a driving shaft through a torque limiter. The separating roller is pressed against a feeding roller to form a nip therebetween where the uppermost sheet P is separated from other sheets P. According to the FR separation system, a separating roller (e.g., a friction roller) is supported by a securing shaft via a torque limiter. The separating roller is pressed against a feeding roller to form a nip therebetween where the uppermost sheet P is separated from other sheets P.

According to this embodiment, the roller pair 210 employs the FRR separation system. For example, the roller pair 210 includes a feeding roller 220 and a separating roller 230. The feeding roller 220 is an upper roller that conveys the sheet P to an inside of a machine. The separating roller 230 is a lower roller that is applied with a driving force in a direction opposite a rotation direction of the feeding roller 220 by a driving shaft through a torque limiter.

A biasing member such as a spring biases the separating roller 230 against the feeding roller 220. The driving force applied to the feeding roller 220 is transmitted to the sheet feeding roller 60 through a clutch, thus rotating the sheet feeding roller 60 counterclockwise in FIG. 1A.

After the leading end of the sheet P strikes the registration roller pair 250 and slacks, the registration roller pair 250 conveys the sheet P to a secondary transfer nip (e.g., a transfer nip N depicted in FIG. 1B) formed between the secondary transfer roller 20 and the intermediate transfer belt 16 at a proper time when the secondary transfer roller 20 transfers a color toner image formed on the intermediate transfer belt 16 onto the sheet P. A bias applied at the secondary transfer nip electrostatically transfers the color toner image formed on the intermediate transfer belt 16 onto a desired transfer position on the sheet P sent to the secondary transfer nip precisely.

Figure 2A:
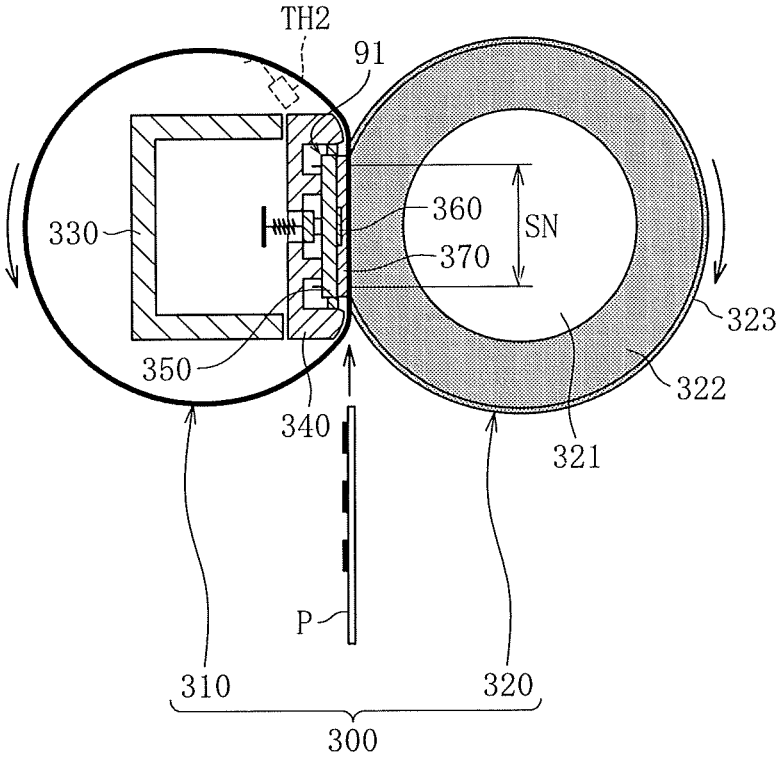
FIG. 2A is a cross-sectional view of a fixing device according to a first embodiment, which is installed in the laser printer depicted in FIG. 1A, illustrating a heater incorporated in the fixing device.
Figure 2B:
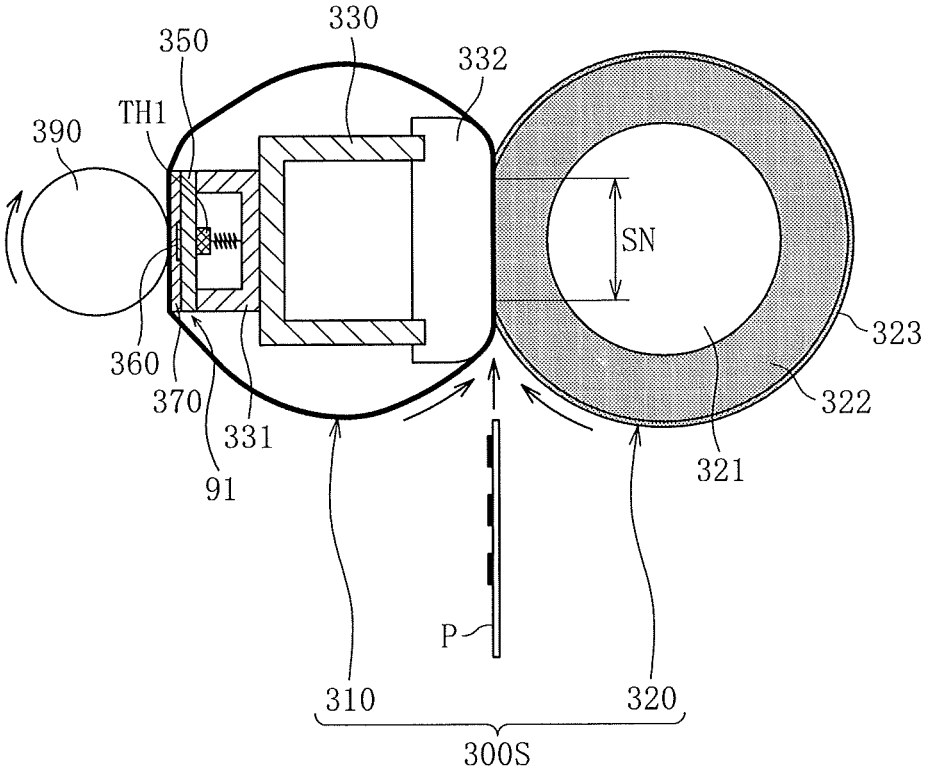
FIG. 2B is a cross-sectional view of a fixing device according to a second embodiment, which is installable in the laser printer depicted in FIG. 1A.
Figure 2C:
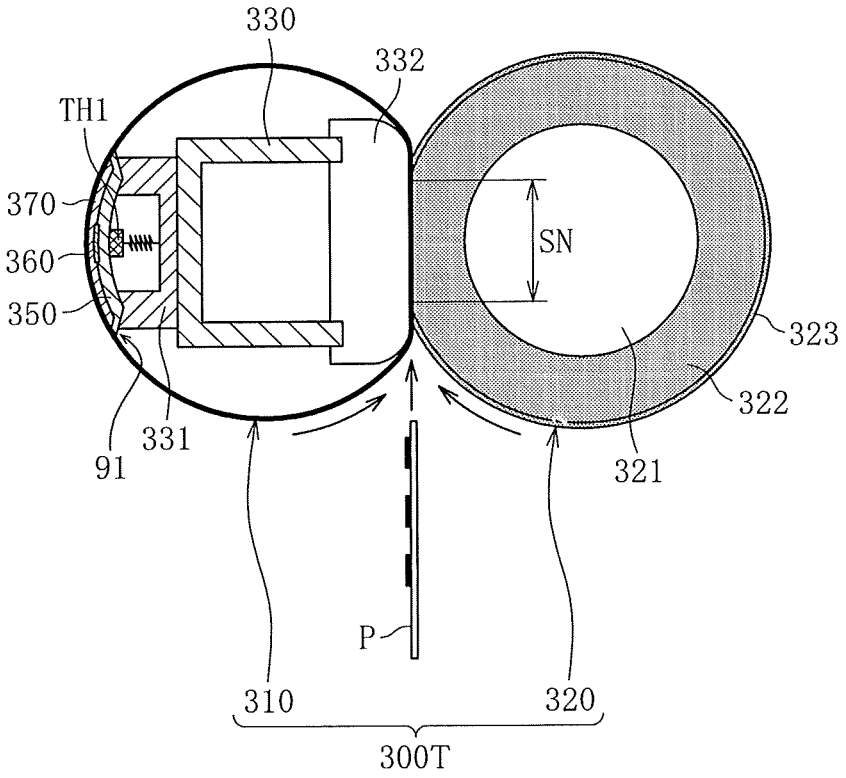
FIG. 2C is a cross-sectional view of a fixing device according to a third embodiment, which is installable in the laser printer depicted in FIG. 1A.
Figure 2D:
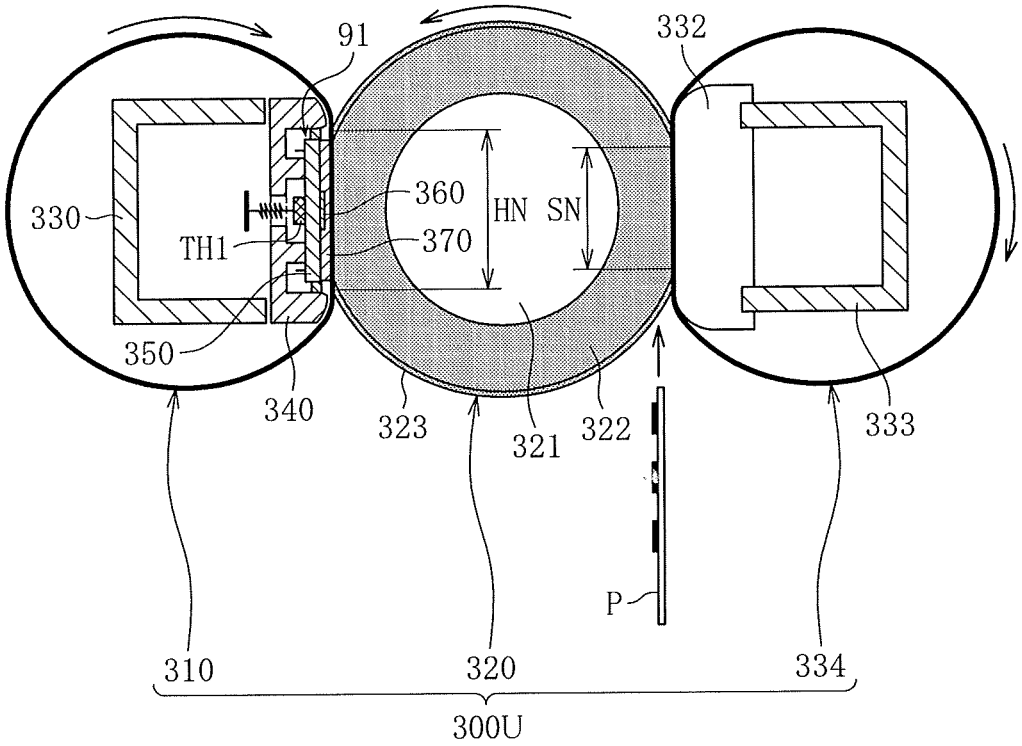
FIG. 2D is a cross-sectional view of a fixing device according to a fourth embodiment, which is installable in the laser printer depicted in FIG. 1A.

A post-transfer conveyance path 33 is disposed above the secondary transfer nip formed between the secondary transfer roller 20 and the intermediate transfer belt 16. The fixing device 300 is disposed in proximity to an upper end of the post-transfer conveyance path 33. The fixing device 300 includes a fixing belt 310 and a pressure roller 320. The fixing belt 310 accommodates a heater. The pressure roller 320, serving as a pressure rotator or a pressure member, rotates while the pressure roller 320 contacts the fixing belt 310 with predetermined pressure. The fixing device 300 has a configuration depicted in FIG. 2A. FIG. 2A is a cross-sectional view of the fixing device 300 according to a first embodiment. Alternatively, the fixing device 300 may have configurations described below with reference to FIGS. 2B, 2C, and 2D. FIG. 2B is a cross-sectional view of a fixing device 300S according to a second embodiment. FIG. 2C is a cross-sectional view of a fixing device 300T according to a third embodiment. FIG. 2D is a cross-sectional view of a fixing device 300U according to a fourth embodiment.

As illustrated in FIG. 1A, a post-fixing conveyance path 35 is disposed above the fixing device 300. At an upper end of the post-fixing conveyance path 35, the post-fixing conveyance path 35 branches to a sheet ejection path 36 and a reverse conveyance path 41. A switcher 42 is disposed at a bifurcation of the post-fixing conveyance path 35. The switcher 42 pivots about a pivot shaft 42*a* as an axis. A sheet ejection roller pair 37 is disposed in proximity to an outlet edge of the sheet ejection path 36.

One end of the reverse conveyance path 41 is at the bifurcation of the post-fixing conveyance path 35. Another end of the reverse conveyance path 41 joins the sheet feeding path 32. A reverse conveyance roller pair 43 is disposed in a middle of the reverse conveyance path 41. A sheet ejection tray 44 is disposed in an upper portion of the laser printer 100. The sheet ejection tray 44 includes a recess directed inward in the laser printer 100.

A powder container 10 (e.g., a toner container) is interposed between the transfer device 15 and the sheet feeder 200. The powder container 10 is detachably attached to the body of the laser printer 100.

The laser printer 100 according to this embodiment secures a predetermined distance from the sheet feeding roller 60 to the secondary transfer roller 20 to convey the sheet P. Hence, the powder container 10 is situated in a dead space defined by the predetermined distance, downsizing the laser printer 100 entirely.

A transfer cover 8 is disposed above the sheet feeder 200 at a front of the laser printer 100 in a drawing direction of the sheet feeder 200. As an operator (e.g., a user and a service engineer) opens the transfer cover 8, the operator inspects an inside of the laser printer 100. The transfer cover 8 mounts a bypass tray 46 and a bypass sheet feeding roller 45 used for a sheet P manually placed on the bypass tray 46 by the operator.

The laser printer 100 according to this embodiment is one example of the image forming apparatus. The image forming apparatus is not limited to a laser printer. For example, the image forming apparatus may be a copier, a facsimile machine, a printer, a printing machine, an inkjet recording apparatus, or a multifunction peripheral (MFP) having at least two of copying, facsimile, printing, scanning, and inkjet recording functions.

A description is provided of operations of the laser printer 100.

Referring to FIG. 1A, the following describes basic operations of the laser printer 100 according to this embodiment, which has the construction described above to perform image formation.

First, a description is provided of operations of the laser printer 100 to print on one side of a sheet P.

As illustrated in FIG. 1A, the sheet feeding roller 60 rotates according to a sheet feeding signal sent from a controller of the laser printer 100. The sheet feeding roller 60 separates an uppermost sheet P from other sheets P of a sheaf of sheets P loaded in the sheet feeder 200 and feeds the uppermost sheet P to the sheet feeding path 32.

When the leading end of the sheet P sent by the sheet feeding roller 60 and the roller pair 210 reaches a nip of the registration roller pair 250, the registration roller pair 250 slacks the sheet P and halts the sheet P temporarily. The registration roller pair 250 conveys the sheet P to the secondary transfer nip at an optimal time when the secondary transfer roller 20 transfers a color toner image formed on the intermediate transfer belt 16 onto the sheet P while the registration roller pair 250 corrects skew of the leading end of the sheet P.

In order to feed a sheaf of sheets P placed on the bypass tray 46, the bypass sheet feeding roller 45 conveys the sheaf of sheets P loaded on the bypass tray 46 one by one from an uppermost sheet P. The sheet P is conveyed through a part of the reverse conveyance path 41 to the nip of the registration roller pair 250. Thereafter, the sheet P is conveyed similarly to the sheet P conveyed from the sheet feeder 200.

The following describes processes for image formation with one process unit, that is, the process unit 1K, and a description of processes for image formation with other process units, that is, the process units 1Y, 1M, and 1C, is omitted.

First, the charger 4K uniformly charges the surface of the image bearer 2K at a high electric potential. The exposure device 7 emits a laser beam L that irradiates the surface of the image bearer 2K according to image data.

The electric potential of an irradiated portion on the surface of the image bearer 2K, which is irradiated with the laser beam L, decreases, forming an electrostatic latent image on the image bearer 2K. The developing device 5K includes a developer bearer 5*a* depicted in FIG. 1B that bears a developer containing toner. Fresh black toner supplied from the toner bottle 6K is transferred onto a portion on the surface of the image bearer 2K, which bears the electrostatic latent image, through the developer bearer 5*a*. The surface of the image bearer 2K transferred with the black toner bears a black toner image developed with the black toner. The primary transfer roller 19K transfers the black toner image formed on the image bearer 2K onto the intermediate transfer belt 16.

A cleaning blade 3*a* depicted in FIG. 1B of the drum cleaner 3K removes residual toner failed to be transferred onto the intermediate transfer belt 16 and therefore adhered on the surface of the image bearer 2K therefrom. The removed residual toner is conveyed by a waste toner conveyer and collected into a waste toner container disposed inside the process unit 1K. The discharger removes residual electric charge from the image bearer 2K from which the drum cleaner 3K has removed the residual toner.

Similarly, in the process units 1Y, 1M, and 1C, yellow, magenta, and cyan toner images are formed on the image bearers 2Y, 2M, and 2C, respectively. The primary transfer rollers 19Y, 19M, and 19C transfer the yellow, magenta, and cyan toner images formed on the image bearers 2Y, 2M, and 2C, respectively, onto the intermediate transfer belt 16 such that the yellow, magenta, and cyan toner images are superimposed on the intermediate transfer belt 16.

The black, yellow, magenta, and cyan toner images transferred and superimposed on the intermediate transfer belt 16 move to the secondary transfer nip formed between the secondary transfer roller 20 and the intermediate transfer belt 16. On the other hand, the registration roller pair 250 resumes rotation at a predetermined time while sandwiching a sheet P that strikes the registration roller pair 250. The registration roller pair 250 conveys the sheet P to the secondary transfer nip formed between the secondary transfer roller 20 and the intermediate transfer belt 16 at a time when the secondary transfer roller 20 transfers the black, yellow, magenta, and cyan toner images superimposed on the intermediate transfer belt 16 properly. Thus, the secondary transfer roller 20 transfers the black, yellow, magenta, and cyan toner images superimposed on the intermediate transfer belt 16 onto the sheet P conveyed by the registration roller pair 250, forming a color toner image on the sheet P.

The sheet P transferred with the color toner image is conveyed to the fixing device 300 through the post-transfer conveyance path 33. The fixing belt 310 and the pressure roller 320 sandwich the sheet P conveyed to the fixing device 300 and fix the unfixed color toner image on the sheet P under heat and pressure. The sheet P bearing the fixed color toner image is conveyed from the fixing device 300 to the post-fixing conveyance path 35.

When the sheet P is sent out of the fixing device 300, the switcher 42 opens the upper end of the post-fixing conveyance path 35 and a vicinity thereof as illustrated with a solid line in FIG. 1A. The sheet P sent out of the fixing device 300 is conveyed to the sheet ejection path 36 through the post-fixing conveyance path 35. The sheet ejection roller pair 37 sandwiches the sheet P sent to the sheet ejection path 36 and is driven and rotated to eject the sheet P onto the sheet ejection tray 44, thus finishing printing on one side of the sheet P.

Next, a description is provided of operations of the laser printer 100 to perform duplex printing.

Similarly to printing on one side of the sheet P, the fixing device 300 sends out the sheet P to the sheet ejection path 36. In order to perform duplex printing, the sheet ejection roller pair 37 is driven and rotated to convey a part of the sheet P to an outside of the laser printer 100.

When a trailing end of the sheet P has passed through the sheet ejection path 36, the switcher 42 pivots about the pivot shaft 42*a* as illustrated with a dotted line in FIG. 1A, closing the upper end of the post-fixing conveyance path 35. Approximately simultaneously with closing of the upper end of the post-fixing conveyance path 35, the sheet ejection roller pair 37 rotates in a direction opposite a direction in which the sheet ejection roller pair 37 conveys the sheet P onto the outside of the laser printer 100, thus conveying the sheet P to the reverse conveyance path 41.

The sheet P conveyed to the reverse conveyance path 41 travels to the registration roller pair 250 through the reverse conveyance roller pair 43. The registration roller pair 250 conveys the sheet P to the secondary transfer nip at a proper time when the secondary transfer roller 20 transfers black, yellow, magenta, and cyan toner images superimposed on the intermediate transfer belt 16 onto a back side of the sheet P, which is transferred with no toner image, that is, in synchronism with reaching of the black, yellow, magenta, and cyan toner images to the secondary transfer nip.

While the sheet P passes through the secondary transfer nip, the secondary transfer roller 20 and the driving roller 18 transfer the black, yellow, magenta, and cyan toner images onto the back side of the sheet P, which is transferred with no toner image, thus forming a color toner image on the sheet P. The sheet P transferred with the color toner image is conveyed to the fixing device 300 through the post-transfer conveyance path 33.

In the fixing device 300, the fixing belt 310 and the pressure roller 320 sandwich the sheet P conveyed to the fixing device 300 and fix the unfixed color toner image on the back side of the sheet P under heat and pressure. The sheet P bearing the color toner image fixed on both sides, that is, a front side and the back side, of the sheet P is conveyed from the fixing device 300 to the post-fixing conveyance path 35.

When the sheet P is sent out of the fixing device 300, the switcher 42 opens the upper end of the post-fixing conveyance path 35 and the vicinity thereof as illustrated with the solid line in FIG. 1A. The sheet P sent out of the fixing device 300 is conveyed to the sheet ejection path 36 through the post-fixing conveyance path 35. The sheet ejection roller pair 37 sandwiches the sheet P sent to the sheet ejection path 36 and is driven and rotated to eject the sheet P onto the sheet ejection tray 44, thus finishing duplex printing on the sheet P.

After the secondary transfer roller 20 transfers the black, yellow, magenta, and cyan toner images superimposed on the intermediate transfer belt 16 onto the sheet P, residual toner adheres to the intermediate transfer belt 16. The belt cleaner 21 removes the residual toner from the intermediate transfer belt 16. The residual toner removed from the intermediate transfer belt 16 is conveyed by the waste toner conveyer and collected into the powder container 10.

A description is provided of a construction of a comparative fixing device.

The comparative fixing device includes a fixing belt and a laminated heater that heats the fixing belt. The laminated heater includes a base that extends in an axial direction of the fixing belt and a plurality of resistive heat generators that is disposed on the base and is electrically connected in parallel. Accordingly, the comparative fixing device suppresses temperature increase in a non-conveyance span where a small recording medium is not conveyed over the fixing belt. A positive temperature coefficient (PTC) heater having a positive temperature coefficient is employed as the resistive heat generator to suppress temperature increase in the non-conveyance span of the fixing belt further, saving energy.

If the plurality of resistive heat generators is connected in parallel, even if one of the resistive heat generators suffers from disconnection, other ones of the resistive heat generators receive an electric current. If a temperature detecting sensor such as a thermistor is disposed in a heating span of each of the resistive heat generators, the temperature of each of the resistive heat generators is controlled separately, preventing abnormal temperature increase of the resistive heat generators.

However, if each of the resistive heat generators is shortened to increase the number of the resistive heat generators so as to suppress temperature increase in the non-conveyance span further, it may be difficult to install the temperature detecting sensor for each of the resistive heat generators in view of space and manufacturing costs. To address this circumstance, the temperature detecting sensor may be installed for one of the resistive heat generators, which is disposed at a center of the base in a longitudinal direction thereof, for example. However, if the one of the resistive heat generators suffers from disconnection, the electric current that flows through other ones of the resistive heat generators may continue increasing, resulting in failure in temperature control.

To address this circumstance, the resistance value of the resistive heat generator sandwiched between two electrodes in a short direction of the resistive heat generator is detected. When the resistance value is greater than a predetermined value due to disconnection of the resistive heat generator, supplying power (e.g., an alternating current) to the resistive heat generator is interrupted. A resistance value R of the resistive heat generator is calculated by measuring a voltage value V between the two electrodes and dividing the voltage value V by an electric current value I that flows between the two electrodes ($R=V/I$). The electric current value I between the electrodes is generally detected by rectifying the alternating current and then converting the rectified current into the voltage value.

However, since supplying power to the resistive heat generator is controlled by a phase control, accuracy in detecting the electric current value may degrade substantially during the phase control. As the resistance value of the resistive heat generator changes in accordance with temperature change due to supplying power to the resistive heat generator, the electric current value changes also. Accordingly, regardless of controlling power, it may also be difficult to determine a time when a controller determines that abnormality (e.g., disconnection of the resistive heat generator) occurs based on the electric current value.

A description is provided of a construction of a heater 91 and the fixing devices 300, 300S, 300T, and 300U according to the first embodiment, the second embodiment, the third embodiment, and the fourth embodiment, respectively, of the present disclosure.

The following describes the construction of the heater 91 of the fixing device 300 according to the first embodiment, which is also installable in the fixing devices 300S, 300T, and 300U.

As illustrated in FIG. 2A, the heater 91 heats the fixing belt 310 of the fixing device 300. The heater 91 is a laminated heater. The heater 91 includes a base 350 and a heat generator 360. The base 350 includes an elongate, thin metal plate and an insulator that coats the metal plate. The heat generator 360 is disposed on the base 350.

Figure 3A:
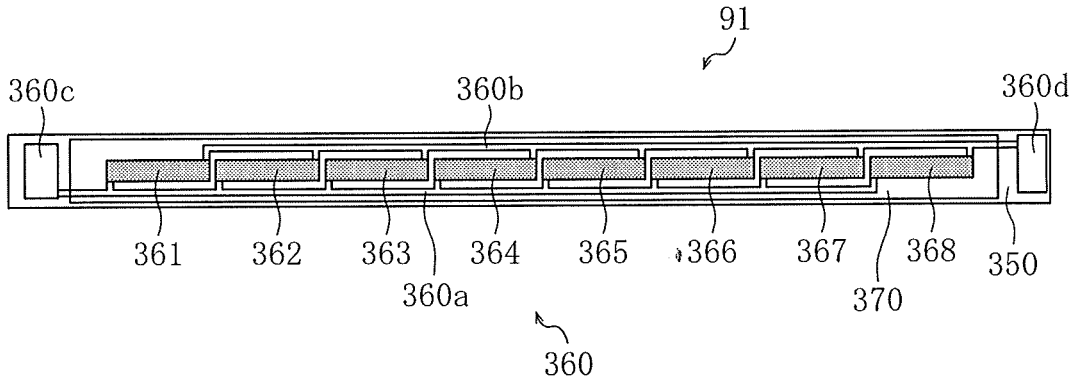
FIG. 3A is a plan view of the heater depicted in FIG. 2A, illustrating a first arrangement of resistive heat generators sandwiched between electrodes disposed at both lateral ends of a heat generator in a longitudinal direction thereof.

As illustrated in FIG. 3A, the heat generator 360 includes a plurality of resistive heat generators 361 to 368 that is aligned linearly in a longitudinal direction of the base 350 with an identical interval between adjacent ones of the resistive heat generators 361 to 368. FIGS. 3A, 3B, 3C, 3D, 3E, 3F, 3G, 3H, 3I, 3J, 3K, and 3L illustrate examples of arrangement of the resistive heat generators 361 to 368.

Figure 4:
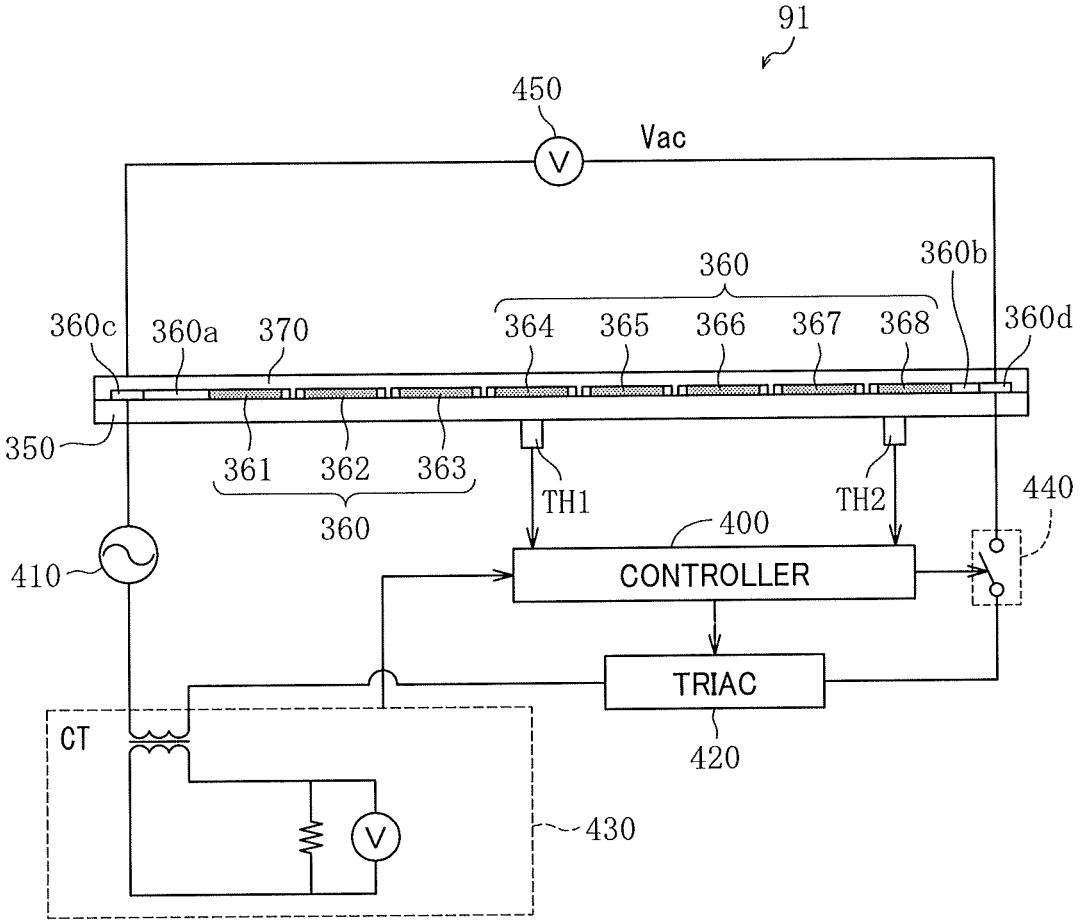
FIG. 4 is a diagram of the heater depicted in FIG. 2A, illustrating a power supply circuit and a controller.

As illustrated in FIG. 3A, feeders 360*a* and 360*b* having a decreased resistance value are disposed linearly at both ends of each of the resistive heat generators 361 to 368, respectively, in a short direction thereof such that the feeder 360*a* is parallel to the feeder 360*b*. Both ends of each of the resistive heat generators 361 to 368 are coupled to the feeders 360*a* and 360*b*, respectively. As illustrated in FIG. 4, a power supply including an alternating current power supply is coupled to electrodes 360*c* and 360*d* coupled to the feeders 360*a* and 360*b*, respectively, at one end of each of the feeders 360*a* and 360*b*.

The heater 91 according to this embodiment includes a first temperature detecting sensor TH1, serving as a first temperature sensor, and a second temperature detecting sensor TH2, serving as a second temperature sensor, which are temperature detectors that detect the temperature of the resistive heat generators 361 to 368. For example, each of the first temperature detecting sensor TH1 and the second temperature detecting sensor TH2 is a thermistor.

As illustrated in FIG. 4, a spring pressingly attaches each of the first temperature detecting sensor TH1 and the second temperature detecting sensor TH2 to a back face of the base 350. The first temperature detecting sensor TH1 is used for temperature control. The second temperature detecting sensor TH2 is used to ensure safety. Each of the two sensors, that is, the first temperature detecting sensor TH1 and the second temperature detecting sensor TH2, is a contact type thermistor having a thermal time constant that is smaller than one second.

The first temperature detecting sensor TH1 for temperature control is disposed in a heating span of the resistive heat generator 364, that is, a fourth resistive heat generator from the left in FIG. 4. The resistive heat generator 364 serves as a primary resistive heat generator disposed in a center span in the longitudinal direction of the base 350, which defines a minimum sheet conveyance span where a minimum size sheet P is conveyed. The second temperature detecting sensor TH2 to ensure safety is disposed in a heating span of the resistive heat generator 368, that is, an eighth resistive heat generator from the left in FIG. 4. The resistive heat generator 368 serves as a secondary resistive heat generator disposed in an endmost span of the heat generator 360 in a longitudinal direction thereof. Alternatively, the second temperature detecting sensor TH2 may be disposed in a heating span of the resistive heat generator 361, that is, a first resistive heat generator from the left in FIG. 4.

Each of the two sensors, that is, the first temperature detecting sensor TH1 and the second temperature detecting sensor TH2, is disposed in heat generating spans defined by the resistive heat generators 364 and 368, respectively, and is not disposed in an interval span between the adjacent ones of the resistive heat generators 361 to 368, which suffers from a decreased heat generation amount. Accordingly, the first temperature detecting sensor TH1 and the second temperature detecting sensor TH2 improve temperature control and facilitate detection of disconnection when a part of the resistive heat generators 361 and 368 suffers from disconnection.

Alternatively, the first temperature detecting sensor TH1 may be disposed in a heating span of any one of the resistive heat generators 363, 365, and 366. The second temperature detecting sensor TH2 may be disposed in a lateral end span in the longitudinal direction of the base 350. For example, the second temperature detecting sensor TH2 may be disposed in a heating span of the resistive heat generator 362, that is, a second resistive heat generator from the left in FIG. 4 or the resistive heat generator 367, that is, a seventh resistive heat generator from the left in FIG. 4. That is, the second temperature detecting sensor TH2 may not be disposed in the endmost span of the heat generator 360 in the longitudinal direction thereof.

FIG. 4 illustrates a power supply circuit situated below the heater 91. The power supply circuit serves as a power supply that supplies power to the resistive heat generators 361 to 368. The power supply circuit includes a controller 400 serving as an electric current controller, the alternating current power supply 410, a triac 420, an electric current detector 430, and a heater relay 440. The alternating current power supply 410, a current transformer CT of the electric current detector 430, the triac 420, and the heater relay 440 are connected in series and disposed between the electrodes 360*c* and 360*d*.

Figure 5A:
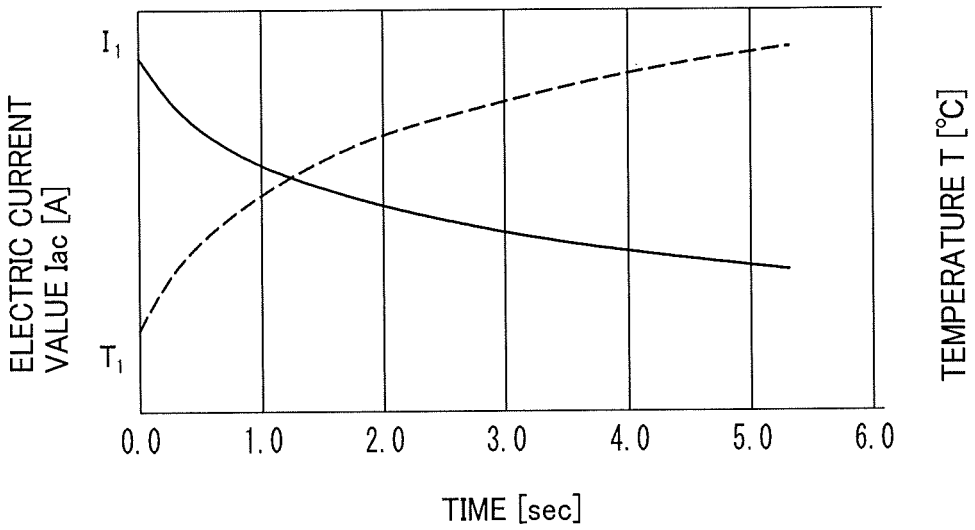
FIG. 5A is a graph illustrating change in a temperature and an electric current of the resistive heat generators incorporated in the heater depicted in FIG. 4.
Figure 5B:
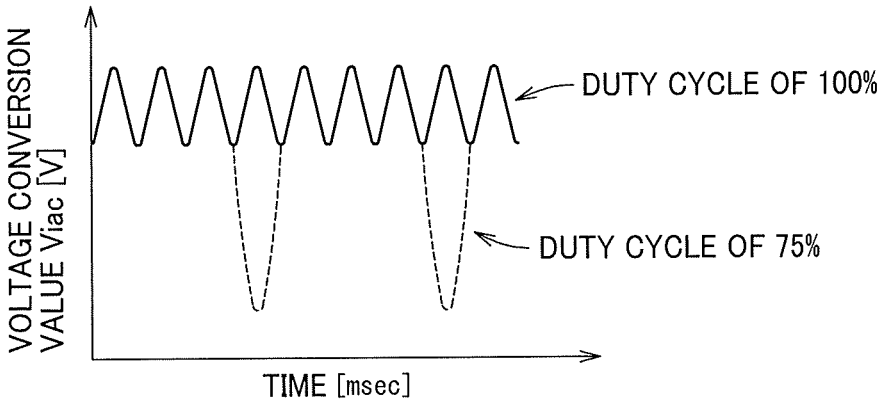
FIG. 5B is a graph illustrating change in a waveform of a voltage under duty control for the resistive heat generators incorporated in the heater depicted in FIG. 4.
Figure 5C:
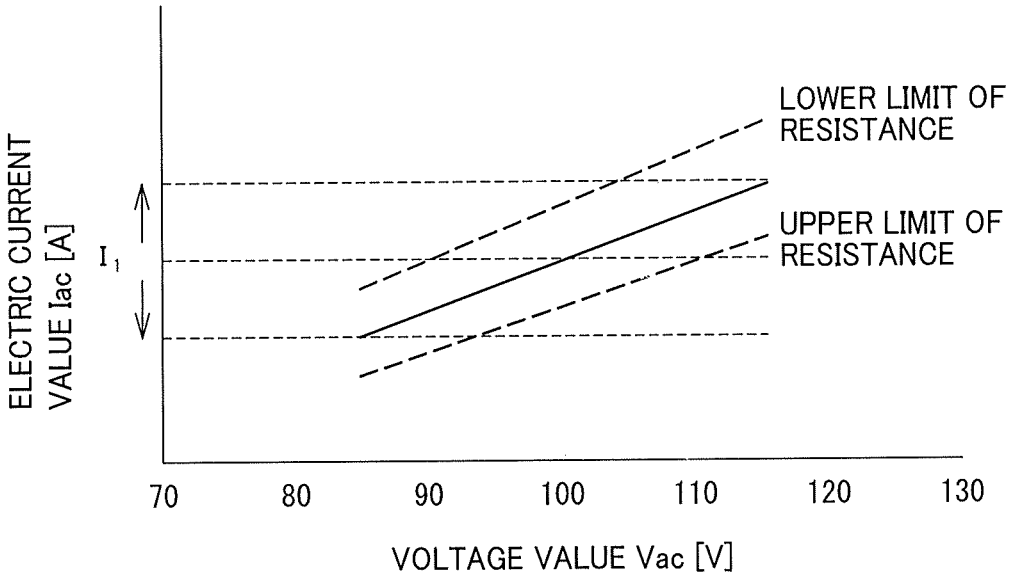
FIG. 5C is a graph illustrating a correlation between the voltage and the electric current of the resistive heat generators incorporated in the heater depicted in FIG. 4.

FIG. 5A is a graph illustrating change in the temperature and the electric current of the resistive heat generators 361 to 368. FIG. 5B is a graph illustrating change in a waveform of the voltage under duty control for the resistive heat generators 361 to 368. FIG. 5C is a graph illustrating a correlation between the voltage and the electric current of the resistive heat generators 361 to 368.

Temperatures $T_4$ and $T_8$ detected by the first temperature detecting sensor TH1 and the second temperature detecting sensor TH2, respectively, are input to the controller 400. Based on the temperature $T_4$ sent from the first temperature detecting sensor TH1, the controller 400 performs duty control with the triac 420 on an electric current supplied to the electrodes 360*c* and 360*d* so that each of the resistive heat generators 361 to 368 attains a predetermined target temperature.

For example, with a duty cycle based on a difference between the current temperature $T_4$ sent from the first temperature detecting sensor TH1 and the target temperature, the controller 400 causes the triac 420 to perform duty control on the electric current that flows through the resistive heat generators 361 to 368. The electric current is zero at a duty cycle of 0%. The electric current is maximum at a duty cycle of 100%. FIG. 5B illustrates a voltage conversion value Viac of the electric current supplied at a duty cycle of 100% and a duty cycle of 75%. Under duty control at the duty cycle of 75%, the voltage conversion value Viac fluctuates substantially in a predetermined cycle.

The controller 400 includes a microcomputer that includes a central processing unit (CPU), a read-only memory (ROM), a random access memory (RAM), and an input-output (I/O) interface. When a sheet P is conveyed through a fixing nip SN formed between the fixing belt 310 and the pressure roller 320 depicted in FIG. 2A, the sheet P draws heat from the fixing belt 310, generating an amount of heat conducted to the sheet P. To address this circumstance, the controller 400 depicted in FIG. 4 controls the electric current supplied to the resistive heat generators 361 to 368 by considering the amount of heat conducted to the sheet P in addition to the temperature $T_4$ sent from the first temperature detecting sensor TH1, thus adjusting the temperature of the fixing belt 310 to a desired temperature.

The electric current detector 430 detects a total sum of the electric current that flows through the resistive heat generators 361 to 368. For example, the controller 400 reads an amount of the electric current that flows between the electrodes 360*c* and 360*d* via a voltage that generates in a secondary resistor of the current transformer CT.

If one of the resistive heat generators 361 to 368 suffers from failure or disconnection, the electric current value read by the controller 400 decreases. For example, if the resistive heat generator 364 of which temperature is detected by the first temperature detecting sensor TH1 suffers from failure or disconnection, the controller 400 does not perform temperature control. Accordingly, regardless of the temperature of other resistive heat generators, that is, the resistive heat generators 361 to 363 and 365 to 368, the triac 420 may continue supplying power to the electrodes 360*c* and 360*d* at the duty cycle of 100%.

To address this circumstance, in the heater 91 according to this embodiment, when the electric current detected by the electric current detector 430 is smaller than a predetermined threshold electric current, the controller 400 turns off the heater relay 440 to interrupt the electric current supplied to the electrodes 360*c* and 360*d*. For example, the electric current detector 430 detects the amount of the electric current that flows through the resistive heat generators 361 to 368 with the voltage conversion value Viac obtained by the current transformer CT by voltage conversion.

The controller 400 compares the voltage conversion value Viac with a predetermined threshold voltage Vith stored in the controller 400 in advance. As a result, when the voltage conversion value Viac is smaller than the threshold voltage Vith, that is, when the amount of the electric current supplied to the resistive heat generators 361 to 368 is smaller than the predetermined threshold electric current, the controller 400 turns off the heater relay 440, interrupting supplying power to the resistive heat generators 361 to 368.

Similarly, the controller 400 may cause the triac 420 to obtain the duty cycle of 0% to interrupt supplying power. However, the controller 400 turns off the heater relay 440 to interrupt the electric current precisely. Alternatively, when the temperature $T_8$ detected by the second temperature detecting sensor TH2 is higher than a predetermined threshold, the controller 400 may turn off the heater relay 440 to interrupt the electric current supplied to the electrodes 360*c* and 360*d* practically.

As illustrated in FIG. 2A, the fixing device 300 according to the first embodiment includes the fixing belt 310 that is thin and has a decreased thermal capacity and the pressure roller 320. For example, the fixing belt 310 includes a tubular base that is made of polyimide (PI) and has an outer diameter of 25 mm and a thickness in a range of from 40 micrometers to 120 micrometers.

The fixing belt 310 includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 micrometers to 50 micrometers to enhance durability of the fixing belt 310 and facilitate separation of the sheet P and a foreign substance from the fixing belt 310. Optionally, an elastic layer that is made of rubber or the like and has a thickness in a range of from 50 micrometers to 500 micrometers may be interposed between the base and the release layer.

The base of the fixing belt 310 may be made of heat resistant resin such as polyetheretherketone (PEEK) or metal such as nickel (Ni) and SUS stainless steel, instead of polyimide. An inner circumferential surface of the fixing belt 310 may be coated with polyimide, PTFE, or the like to produce a slide layer.

The pressure roller 320 has an outer diameter of 25 mm, for example. The pressure roller 320 includes a cored bar 321, an elastic layer 322, and a release layer 323. The cored bar 321 is solid and made of metal such as iron. The elastic layer 322 coats the cored bar 321. The release layer 323 coats an outer surface of the elastic layer 322. The elastic layer 322 is made of silicone rubber and has a thickness of 3.5 mm, for example. In order to facilitate separation of the sheet P and the foreign substance from the pressure roller 320, the release layer 323 that is made of fluororesin and has a thickness of about 40 micrometers, for example, is preferably disposed on the outer surface of the elastic layer 322. A biasing member presses the pressure roller 320 against the fixing belt 310.

A stay 330 and a holder 340 are disposed inside a loop formed by the fixing belt 310 and extended in an axial direction of the fixing belt 310. The stay 330 includes a channel made of metal. Both lateral ends of the stay 330 in a longitudinal direction thereof are supported by side plates of the heater 91, respectively. The stay 330 receives pressure from the pressure roller 320 precisely to form the fixing nip SN stably.

The holder 340 holds the base 350 of the heater 91 and is supported by the stay 330. The holder 340 is preferably made of heat resistant resin having a decreased thermal conductivity, such as liquid crystal polymer (LCP). Accordingly, the holder 340 reduces conduction of heat thereto, improving heating of the fixing belt 310.

In order to prevent contact with a high temperature portion of the base 350, the holder 340 has a shape that allows the holder 340 to support the base 350 at two positions in proximity to both ends of the base 350 in a short direction thereof. Accordingly, the holder 340 reduces conduction of heat thereto further, improving heating of the fixing belt 310.

As illustrated in FIG. 4, a thin, insulating layer 370 covers the resistive heat generators 361 to 368 and the feeders 360*a* and 360*b*. For example, the insulating layer 370 is made of heat resistant glass and has a thickness of 75 micrometers. The insulating layer 370 insulates and protects the resistive heat generators 361 to 368 and the feeders 360*a* and 360*b* while retaining smooth sliding of the fixing belt 310 as described below.

The base 350 is preferably made of aluminum, stainless steel, or the like that is available at reduced costs. Alternatively, instead of metal, the base 350 may be made of ceramic, such as alumina and aluminum nitride, or a non-metallic material, such as glass and mica, which has an increased heat resistance and an increased insulation. In order to improve evenness of heat generated by the heater 91 so as to enhance quality of an image formed on a sheet P, the base 350 may be made of a material that has an increased thermal conductivity such as copper, graphite, and graphene. According to this embodiment, the base 350 is made of alumina and has a short width of 8 mm, a longitudinal width of 270 mm, and a thickness of 1.0 mm.

For example, the resistive heat generators 361 to 368 are produced as below. Silver-palladium (AgPd), glass powder, and the like are mixed into paste. The paste coats the base 350 by screen printing or the like. Thereafter, the base 350 is subject to firing. According to this embodiment, the resistive heat generators 361 to 368 have a resistance value of 80Ω at an ambient temperature.

Alternatively, the resistive heat generators 361 to 368 may be made of a resistive material such as a silver alloy (AgPt) and ruthenium oxide ($RuO_2$). The feeders 360*a* and 360*b* and the electrodes 360*c* and 360*d* are made of a material prepared with silver (Ag) or silver-palladium (AgPd) by screen printing or the like.

An insulating layer side face of each of the resistive heat generators 361 to 368, which is disposed opposite the insulating layer 370, contacts and heats the fixing belt 310 depicted in FIG. 2A, increasing the temperature of the fixing belt 310 by conduction of heat so that the fixing belt 310 heats and fixes the unfixed toner image on the sheet P conveyed through the fixing nip SN.

A description is provided of examples of arrangement of the resistive heat generators 361 to 368.

FIGS. 3A, 3B, 3C, 3D, 3E, 3F, 3G, 3H, 3I, 3J, 3K, and 3L illustrate the resistive heat generators 361 to 368 with first to twelfth arrangements thereof, respectively. As illustrated in FIG. 3A, the heat generator 360 is divided into eight sections, that is, the resistive heat generators 361 to 368, in the longitudinal direction of the heat generator 360. The resistive heat generators 361 to 368 are electrically connected in parallel. As illustrated in FIG. 3A, each of the resistive heat generators 361 to 368 is a rectangular, laminated heat generator. Alternatively, as illustrated in FIGS. 3G, 3H, 3I, 3J, 3K, and 3L, firing patterns for the resistive heat generators 361 to 368 may be turned to be serpentine so as to attain a desired output (e.g., a resistance value). As illustrated in FIGS. 3G, 3H, 3I, 3J, 3K, and 3L, in each of the resistive heat generators 361 to 368, a narrow wire is turned twice to produce a bending pattern with one reciprocation and a half.

The material and the thermal conductivity of each of the base 350 and the resistive heat generators 361 to 368 are adjusted so that the resistive heat generators 361 to 368 heat the fixing belt 310 at the fixing nip SN through the base 350 also. Hence, the base 350 is preferably made of a material having an increased thermal conductivity such as aluminum nitride.

A gap is provided between adjacent ones of the resistive heat generators 361 to 368 for insulation. If the gap is excessively great, an amount of heat generation may decrease at the gap, causing variation in fixing. Conversely, if the gap is excessively small, a short circuit may occur between the resistive heat generators 361 to 368.

To address this circumstance, the size of the gap is preferably in a range of from 0.3 mm to 1.0 mm and more preferably in a range of from 0.4 mm to 0.7 mm. As described above, the resistive heat generators 361 to 368 heat the fixing belt 310 at the fixing nip SN through the base 350, suppressing variation in fixing caused by the gap between the adjacent ones of the resistive heat generators 361 to 368.

As illustrated in FIG. 5A, the resistive heat generators 361 to 368 may be made of a material that has a positive temperature coefficient (PTC) property. The material having the PTC property is characterized in that the resistance value increases as a temperature T increases, that is, a heater output decreases as an electric current I decreases. For example, a temperature coefficient of resistance (TCR) is 1,500 parts per million (PPM). A memory of the controller 400 stores the TCR.

Accordingly, if printing is performed with a sheet P having a narrow width that is smaller than a combined width of the resistive heat generators 361 to 368, for example, if the width of the sheet P is equivalent to a combined width of the resistive heat generators 363 to 366 or smaller, since the sheet P does not draw heat from the resistive heat generators 361, 362, 367, and 368 that are disposed outboard from the width of the sheet P, the resistive heat generators 361, 362, 367, and 368 are subject to temperature increase. Consequently, the resistance value of the resistive heat generators 361, 362, 367, and 368 increases.

Since a constant voltage is applied to the resistive heat generators 361 to 368, an output from the resistive heat generators 361, 362, 367, and 368 disposed outboard from the width of the sheet P decreases relatively, suppressing temperature increase of the resistive heat generators 361, 362, 367, and 368 that are disposed at both lateral ends of the heat generator 360 in the longitudinal direction thereof. If the resistive heat generators 361 to 368 are electrically connected in series, a sole method to suppress temperature increase of the resistive heat generators 361, 362, 367, and 368 that are disposed outboard from the width of the sheet P during continuous printing is to decrease the printing speed. To address this circumstance, the resistive heat generators 361 to 368 are electrically connected in parallel, suppressing temperature increase in a non-conveyance span where the sheet P is not conveyed while retaining the printing speed.

The arrangement of the resistive heat generators 361 to 368 is not limited to the first arrangement illustrated in FIG. 3A. With the first arrangement of the resistive heat generators 361 to 368 illustrated in FIG. 3A, an interval that is continuous in the short direction of the resistive heat generators 361 to 368 is provided between adjacent ones of the resistive heat generators 361 to 368. Accordingly, the heat generator 360 generates a decreased amount of heat in the interval, causing the fixing device 300 to be susceptible to variation in fixing the toner image on the sheet P. To address this circumstance, as illustrated in FIGS. 3B and 3C, the resistive heat generators 361 to 368 are arranged to overlap each other at both lateral ends of each of the resistive heat generators 361 to 368 in a longitudinal direction thereof.

Figure 3B:
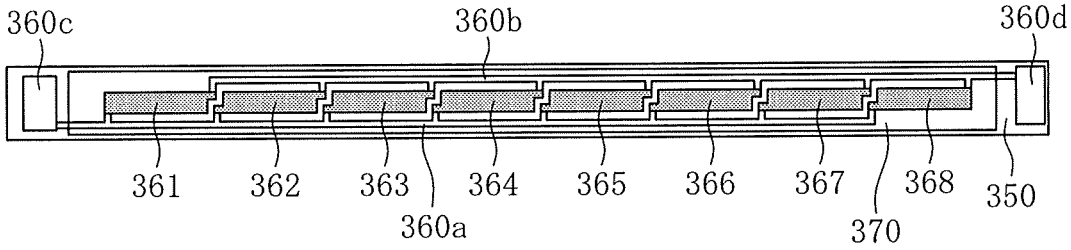
FIG. 3B is a plan view of the heater depicted in FIG. 2A, illustrating a second arrangement of the resistive heat generators depicted in FIG. 3A.

As illustrated in FIG. 3B, each of the resistive heat generators 361 to 368 includes a step (e.g., an L-shaped cut portion) disposed at one lateral end or both lateral ends of each of the resistive heat generators 361 to 368 in the longitudinal direction thereof. The step of one of the resistive heat generators 361 to 368 overlaps the step of an adjacent one of the resistive heat generators 361 to 368.

Figure 3C:
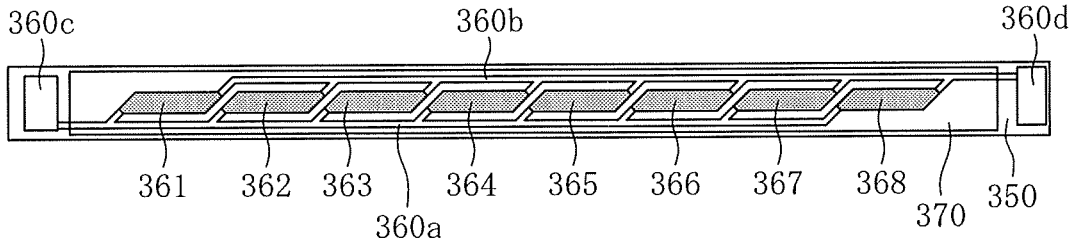
FIG. 3C is a plan view of the heater depicted in FIG. 2A, illustrating a third arrangement of the resistive heat generators depicted in FIG. 3A.
Figure 3D:
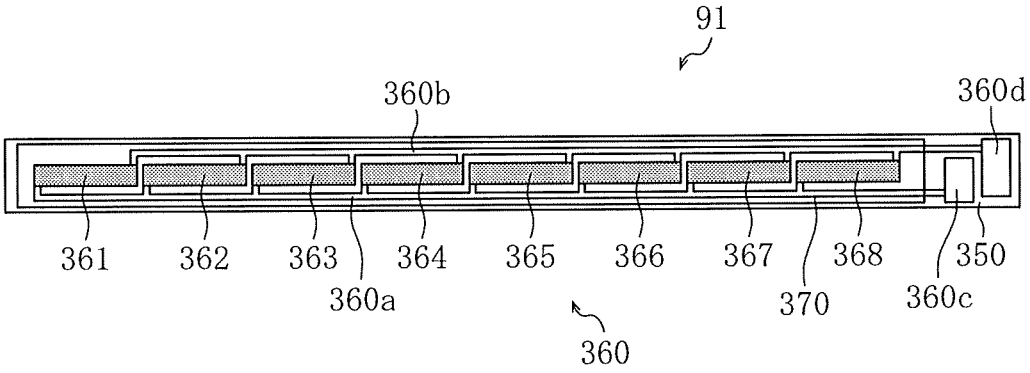
FIG. 3D is a plan view of the heater depicted in FIG. 2A, illustrating a fourth arrangement of the resistive heat generators with the electrodes disposed at one lateral end of the heat generator in the longitudinal direction thereof.
Figure 3E:
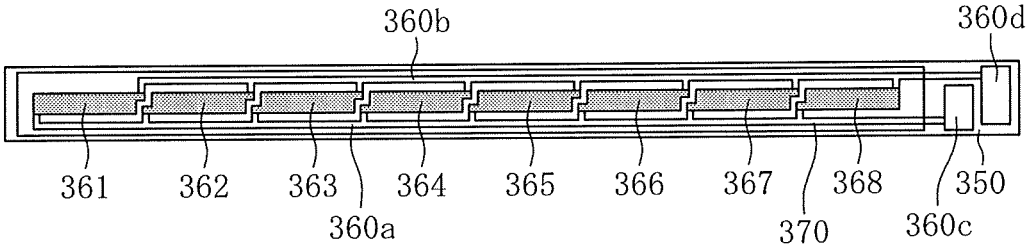
FIG. 3E is a plan view of the heater depicted in FIG. 2A, illustrating a fifth arrangement of the resistive heat generators depicted in FIG. 3D.
Figure 3F:
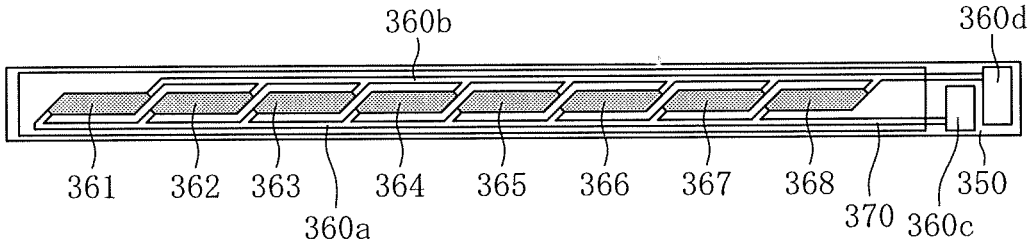
FIG. 3F is a plan view of the heater depicted in FIG. 2A, illustrating a sixth arrangement of the resistive heat generators depicted in FIG. 3D.
Figure 3G:
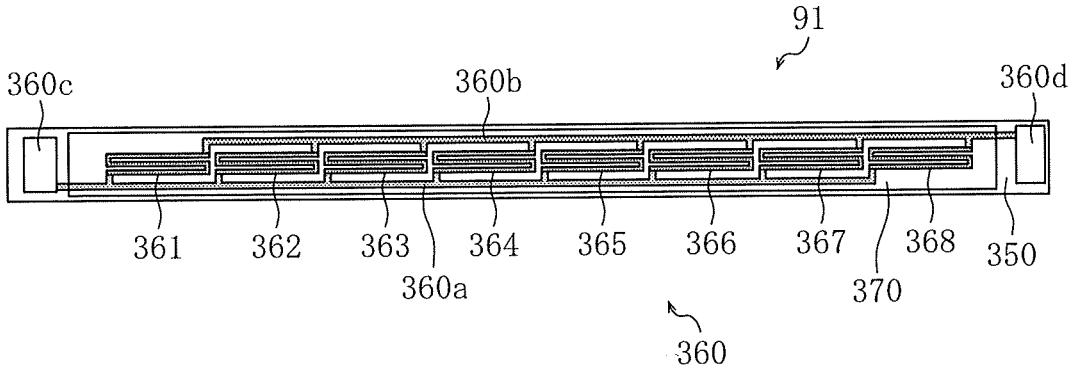
FIG. 3G is a plan view of the heater depicted in FIG. 2A, illustrating a seventh arrangement of a serpentine pattern of the resistive heat generators sandwiched between the electrodes disposed at both lateral ends of the heat generator in the longitudinal direction thereof.
Figure 3H:
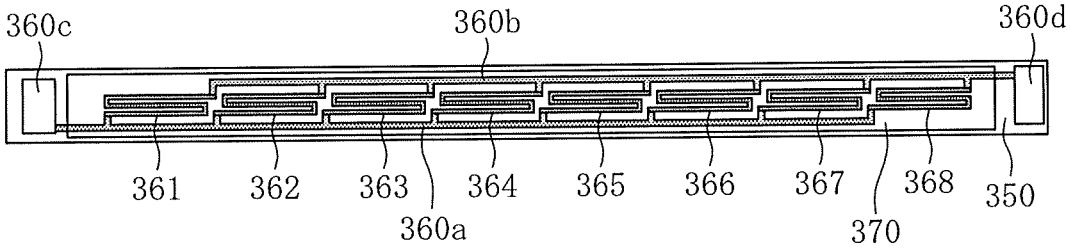
FIG. 3H is a plan view of the heater depicted in FIG. 2A, illustrating an eighth arrangement of the resistive heat generators depicted in FIG. 3G.
Figure 3I:
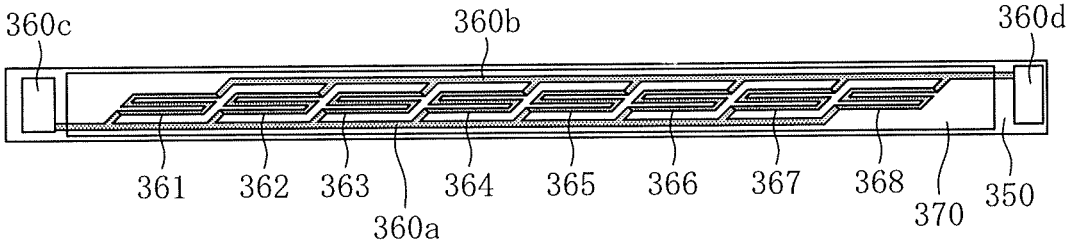
FIG. 3I is a plan view of the heater depicted in FIG. 2A, illustrating a ninth arrangement of the resistive heat generators depicted in FIG. 3G.
Figure 3J:
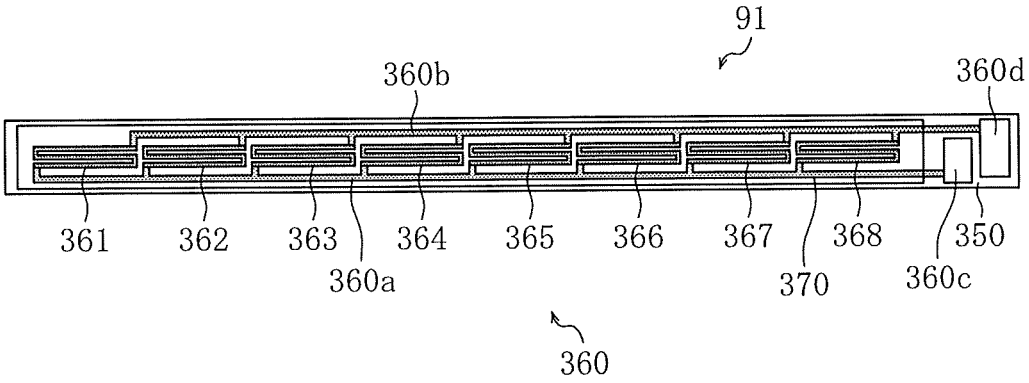
FIG. 3J is a plan view of the heater depicted in FIG. 2A, illustrating a tenth arrangement of a serpentine pattern of the resistive heat generators with the electrodes disposed at one lateral end of the heat generator in the longitudinal direction thereof.
Figure 3K:
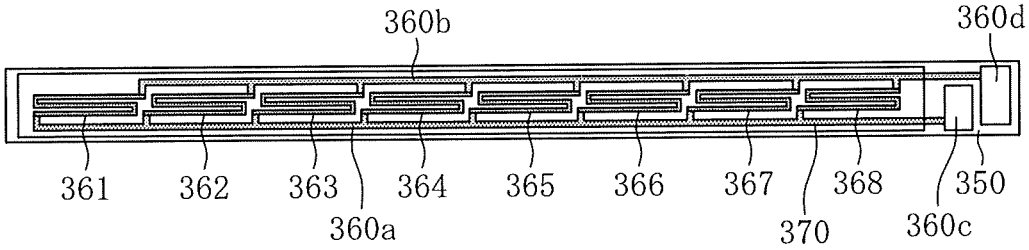
FIG. 3K is a plan view of the heater depicted in FIG. 2A, illustrating an eleventh arrangement of the resistive heat generators depicted in FIG. 3J.
Figure 3L:
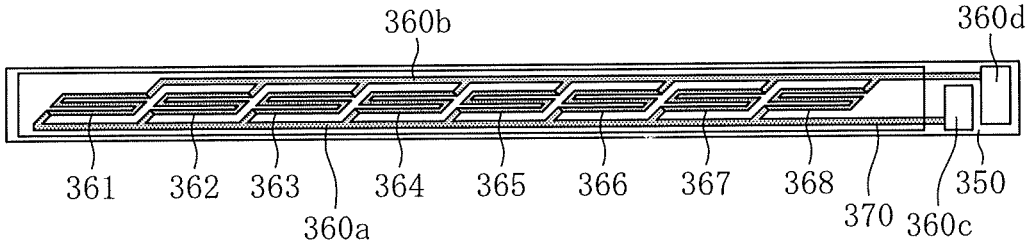
FIG. 3L is a plan view of the heater depicted in FIG. 2A, illustrating a twelfth arrangement of the resistive heat generators depicted in FIG. 3J.

As illustrated in FIG. 3C, each of the resistive heat generators 361 to 368 includes a slope (e.g., an inclined cut portion) disposed at both lateral ends of each of the resistive heat generators 361 to 368 in the longitudinal direction thereof. The slope of one of the resistive heat generators 361 to 368 overlaps the slope of an adjacent one of the resistive heat generators 361 to 368. Thus, as illustrated in FIGS. 3B and 3C, the resistive heat generators 361 to 368 overlap each other at both lateral ends of each of the resistive heat generators 361 to 368 in the longitudinal direction thereof, suppressing decrease in the amount of heat generation at the interval between the adjacent ones of the resistive heat generators 361 to 368 and thereby suppressing resultant adverse affecting.

As illustrated in FIGS. 3A, 3B, and 3C, the electrodes 360*c* and 360*d* sandwich the resistive heat generators 361 to 368 in the longitudinal direction of the heat generator 360. Alternatively, as illustrated in FIGS. 3D, 3E, 3F, 3J, 3K, and 3L, the electrodes 360*c* and 360*d* may be disposed at one lateral end of the heat generator 360 in the longitudinal direction thereof. The electrodes 360*c* and 360*d* disposed at one lateral end of the heat generator 360 in the longitudinal direction thereof save space in the longitudinal direction.

A description is provided of an operation of the fixing device 300 to fix a toner image on a sheet P.

As illustrated in FIG. 2A, as the sheet P conveyed in a direction indicated by an arrow passes through the fixing nip SN, the fixing belt 310 and the pressure roller 320 sandwich the sheet P and fix the toner image on the sheet P under heat. While the fixing belt 310 slides over the insulating layer 370 of the heat generator 360, the heat generator 360 heats the fixing belt 310.

Under a temperature control to cause the heat generator 360 to heat the fixing belt 310 to a predetermined temperature, if the first temperature detecting sensor TH1 is installed solely, when the resistive heat generator 364 disposed opposite the first temperature detecting sensor TH1 as illustrated in FIG. 4 solely suffers from partial disconnection and interruption of power supply, the temperature of the resistive heat generator 364 does not increase. To address this circumstance, in order to retain the resistive heat generator 364 at a constant temperature, the temperature control continues supplying the electric current to other normal resistive heat generators, that is, the resistive heat generators 361 to 363 and 365 to 368, excessively, causing an abnormally increased temperature.

To address this circumstance, according to this embodiment, the second temperature detecting sensor TH2 is disposed in the heating span of the resistive heat generator 368 situated at one lateral end of the heat generator 360 in the longitudinal direction thereof. The second temperature detecting sensor TH2 detects the temperature $T_8$ of the resistive heat generator 368. If the temperature $T_8$ is the abnormally increased temperature or higher, the controller 400 controls the triac 420 to interrupt supplying the electric current to the electrodes 360*c* and 360*d*. Also, if the second temperature detecting sensor TH2 suffers from disconnection and thereby the resistive heat generator 368 has a predetermined temperature TN or lower, that is, if the temperature $T_8$ is lower than the predetermined temperature TN, the controller 400 controls the triac 420 to interrupt supplying the electric current to the electrodes 360*c* and 360*d*.

A description is provided of variations of the fixing device 300.

The fixing device 300 according to the first embodiment depicted in FIG. 2A provides variations thereof.

Referring to FIGS. 2B, 2C, and 2D, the following describes a construction of the fixing devices 300S, 300T, and 300U according to the second embodiment, the third embodiment, and the fourth embodiment, respectively.

As illustrated in FIG. 2B, the fixing device 300S according to the second embodiment includes a pressing roller 390 disposed opposite the pressure roller 320 via the fixing belt 310. The pressing roller 390 and the heater 91 sandwich the fixing belt 310 such that the heater 91 heats the fixing belt 310.

The heater 91 is disposed inside the loop formed by the fixing belt 310. A supplementary stay 331 is mounted on a first side of the stay 330. A nip forming pad 332 serving as a nip former is mounted on a second side of the stay 330, which is opposite the first side thereof. The heater 91 is supported by the supplementary stay 331. The pressure roller 320 is pressed against the nip forming pad 332 via the fixing belt 310 to form the fixing nip SN between the fixing belt 310 and the pressure roller 320.

As illustrated in FIG. 2C, the fixing device 300T according to the third embodiment includes the heater 91 disposed inside the loop formed by the fixing belt 310. Since the fixing device 300T eliminates the pressing roller 390 depicted in FIG. 2B, in order to increase the length for which the heater 91 contacts the fixing belt 310 in a circumferential direction thereof, the base 350 and the insulating layer 370 of the heater 91 are curved into an arc in cross-section that corresponds to a curvature of the fixing belt 310. The heat generator 360 is disposed at a center of the base 350, that is arc-shaped, in the circumferential direction of the fixing belt 310. Except for elimination of the pressing roller 390 and the shape of the heater 91, the fixing device 300T according to the third embodiment is equivalent to the fixing device 300S according to the second embodiment depicted in FIG. 2B.

As illustrated in FIG. 2D, the fixing device 300U according to the fourth embodiment defines a heating nip HN separately from the fixing nip SN. For example, the nip forming pad 332 and a stay 333 that includes a channel made of metal are disposed opposite the fixing belt 310 via the pressure roller 320. A pressure belt 334 that is rotatable accommodates the nip forming pad 332 and the stay 333. As a sheet P bearing a toner image is conveyed through the fixing nip SN formed between the pressure belt 334 and the pressure roller 320, the pressure belt 334 and the pressure roller 320 heat and fix the toner image on the sheet P. Except for the pressure belt 334 accommodating the nip forming pad 332 and the stay 333, the fixing device 300U according to the fourth embodiment is equivalent to the fixing device 300 according to the first embodiment depicted in FIG. 2A.

Alternatively, as illustrated in FIG. 2A with a dotted line, a biasing member may press the second temperature detecting sensor TH2, that is used to ensure safety, against the inner circumferential surface of the fixing belt 310. The second temperature detecting sensor TH2 is disposed downstream from the resistive heat generator 368 in a rotation direction of the fixing belt 310. As illustrated in FIG. 4, the second temperature detecting sensor TH2 is disposed opposite the inner circumferential surface of the fixing belt 310 in the heating span of the resistive heat generator 368 that is different from the heating span of the resistive heat generator 364 of which temperature is detected by the first temperature detecting sensor TH1 used for temperature control. As the number of resistive heat generators increases, it is difficult to spare a space for temperature detecting sensors. To address this circumstance, the second temperature detecting sensor TH2 is disposed as described above with reference to FIG. 2A, making it less difficult to spare the space for the temperature detecting sensors. Alternatively, the second temperature detecting sensor TH2 used to ensure safety may be disposed opposite the inner circumferential surface of the fixing belt 310 in the heating span of each of the resistive heat generators 361 to 363 and 365 to 367 in addition to the resistive heat generator 368.

A description is provided of an operation upon abnormality detection.

Figure 6A:
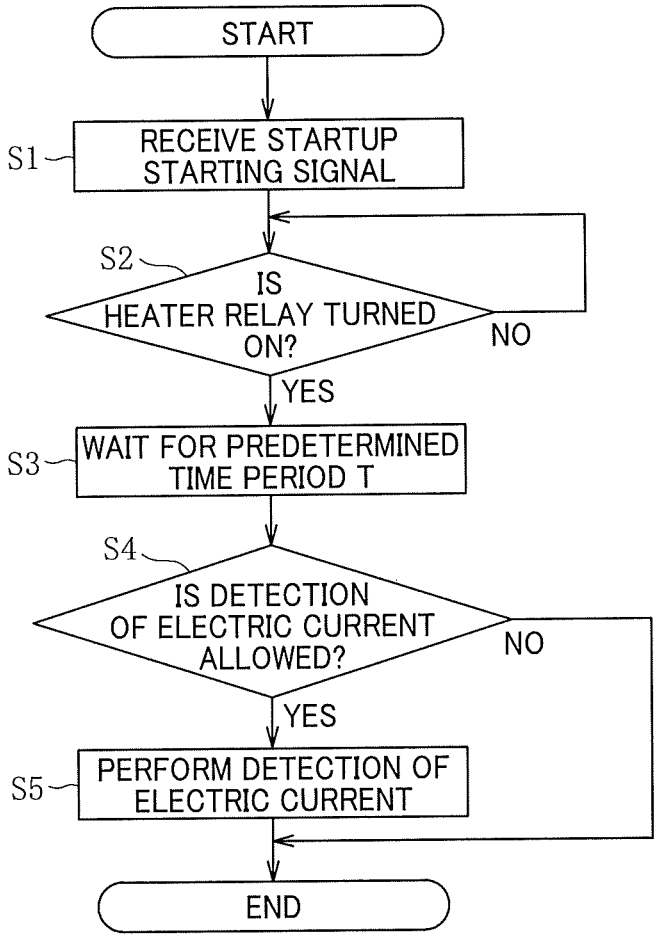
FIG. 6A is a flowchart illustrating basic control processes performed by the controller depicted in FIG. 4 with an electric current detector.
Figure 6B:
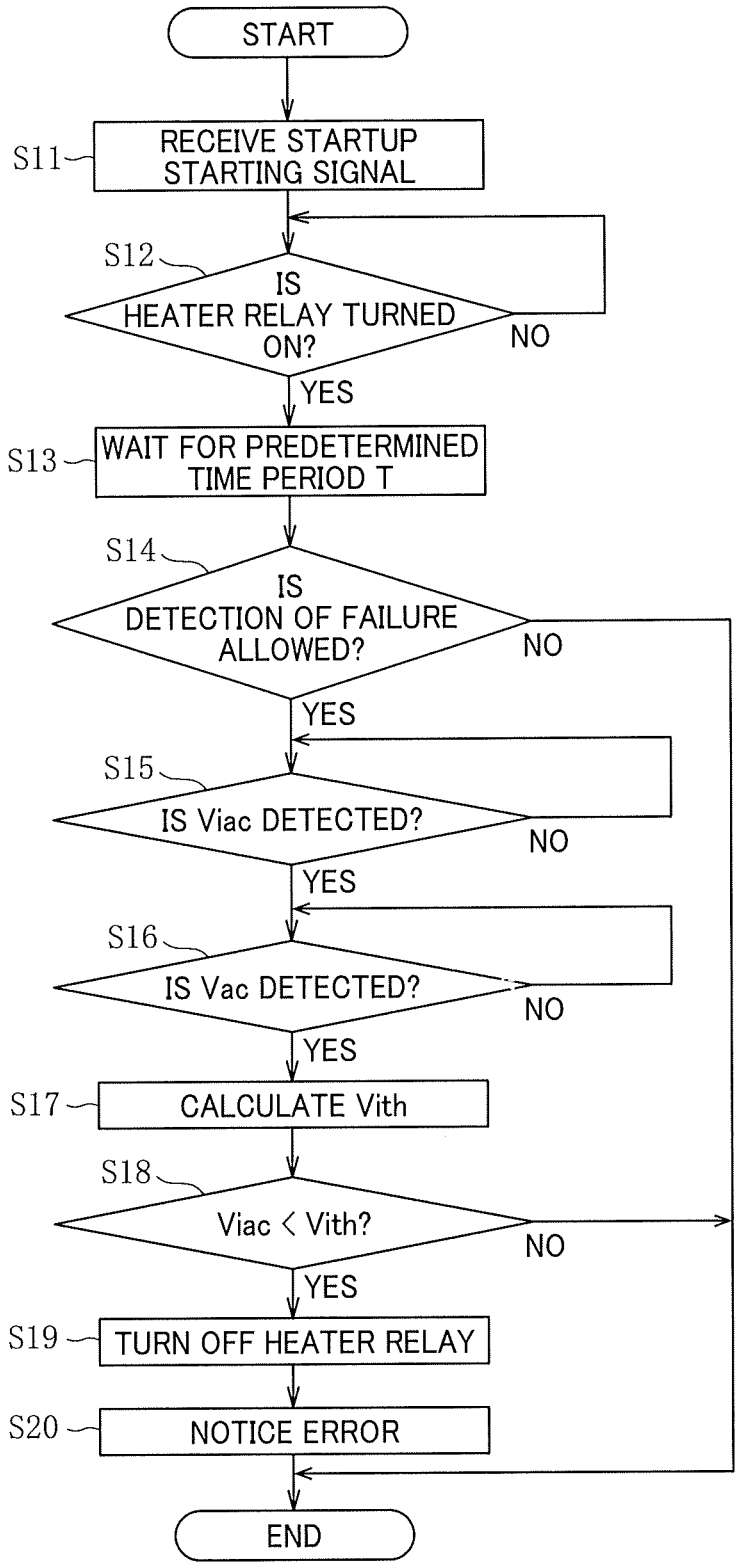
FIG. 6B is a flowchart illustrating details of the basic control processes depicted in FIG. 6A.
Figure 6C:
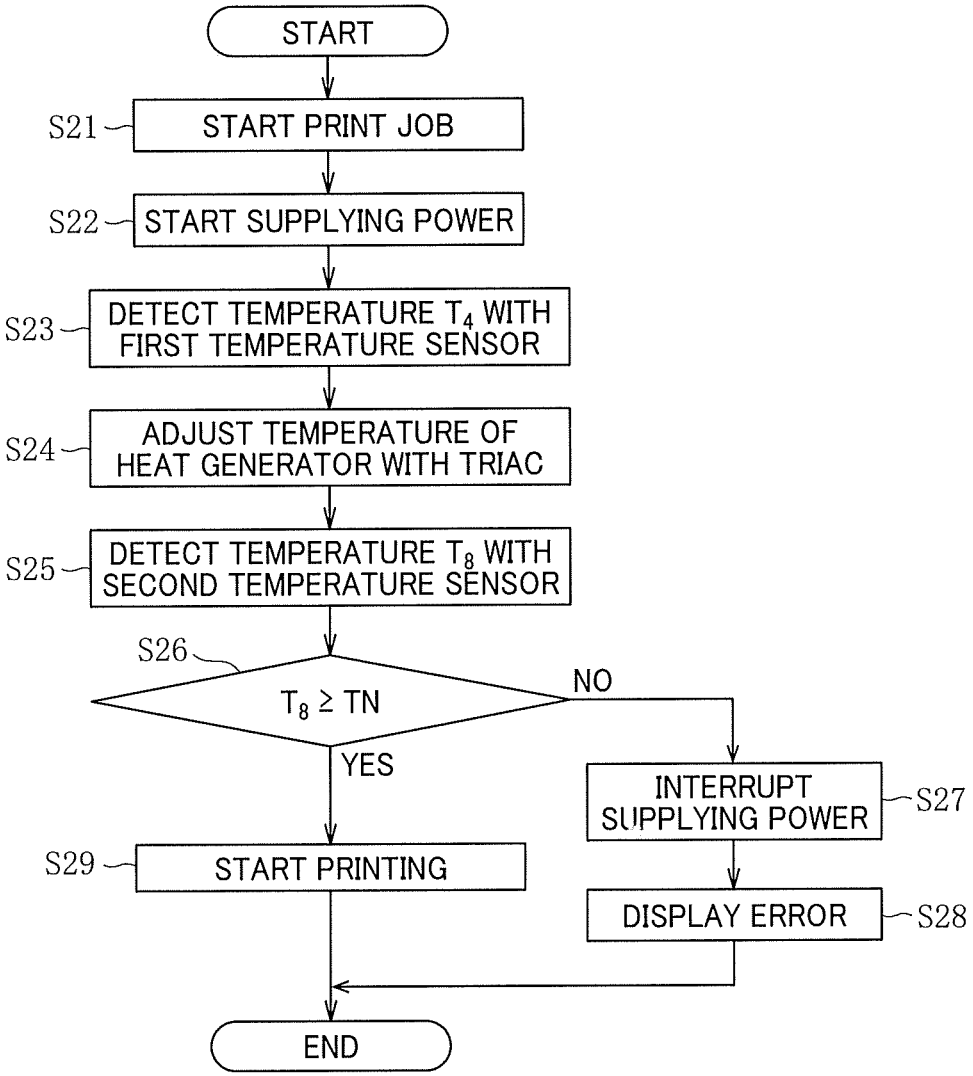
FIG. 6C is a flowchart illustrating control processes performed by the controller depicted in FIG. 4 with a first temperature detecting sensor and a second temperature detecting sensor.

Referring to FIGS. 6A, 6B, and 6C illustrating flowcharts, a description is provided of control processes performed by the controller 400 upon abnormality detection.

Although the description is provided with the fixing device 300 depicted in FIG. 2A, the control processes described below are also applied to the fixing devices 300S, 300T, and 300U depicted in FIGS. 2B, 2C, and 2D, respectively.

FIG. 6A is a flowchart illustrating basic control processes to control the heater 91. In step S1, the controller 400 receives a startup starting signal that starts starting up the heater 91 or the fixing device 300. In step S2, the controller 400 determines whether or not the heater relay 440 is turned on based on the startup starting signal. The controller 400 reads the voltage conversion value Viac obtained by the current transformer CT of the electric current detector 430 by voltage conversion. A time to read the voltage conversion value Viac is immediately after starting up of the fixing device 300 starts.

In step S3, the controller 400 waits for a predetermined time period T [ms]. For example, the time immediately after starting up of the fixing device 300 starts is preferably a time when the predetermined time period T [ms] has elapsed after the heater relay 440 is turned on like step S3. It is because, due to a property of a circuit of the electric current detector 430, it takes the predetermined time period T [ms] before the current transformer CT converts the electric current value into the voltage value and detects the electric current stably.

After the predetermined time period T [ms] elapses, the controller 400 determines whether or not detection of the electric current is allowed in step S4. If the controller 400 determines that detection of the electric current is allowed in step S4 (YES in step S4), the controller 400 performs detection of the electric current, that is, the controller 400 reads the voltage conversion value Viac in step S5. When the controller 400 reads the voltage conversion value Viac, the controller 400 preferably performs calculation in view of affection of noise picked up while detecting the electric current, for example, by performing sampling for detecting the electric current for a plurality of times within a predetermined time period and excluding a maximum value and a minimum value of electric current values obtained by detection for the plurality of times. If the controller 400 determines that detection of the electric current is not allowed in step S4 (NO in step S4), the control processes finish.

The sampling for detecting the electric current is performed in a state in which a waveform of an electric current output by the alternating current power supply 410 remains constant for a predetermined time period or longer taken to detect the electric current and the voltage precisely. The predetermined time period taken to detect the electric current and the voltage precisely is at least 100 msec or longer, preferably 200 msec or longer.

If the sampling for detecting the electric current is performed for the plurality of times within the predetermined time period when starting up the fixing device 300, as illustrated in FIG. 5B, the electric current is detected most precisely at the duty cycle of 100%. For example, the electric current is detected most precisely when a waveform in a full turning-on state in which a waveform of an alternating current is created solely in an ON section at the duty cycle of 100% remains constant for the predetermined time period or longer. At the duty cycle of 75%, for example, the electric current value decreases at constant intervals. Accordingly, a time period for detecting the electric current is not lengthened, causing the electric current detector 430 to be susceptible to noise. Conversely, if the electric current is detected at the duty cycle of 100% when starting up the fixing device 300, the controller 400 determines whether or not abnormality occurs before a sheet P is conveyed to the fixing nip SN, preventing faulty fixing and faulty printing advantageously.

However, even if the duty cycle is smaller than 100%, if the waveform remains for the predetermined time period at a constant duty cycle while the electric current is detected, the controller 400 also predicts an amount of decrease in the electric current value described above under duty control. Accordingly, after the fixing device 300 is started up, even in a state in which the temperature of the resistive heat generators 361 to 368 increases in a certain degree, the electric current is detected as long as the waveform continues at the constant duty cycle.

A solid line in FIG. 5C indicates a target correlation between the electric current and the voltage of the resistive heat generators 361 to 368. Dotted lines above and below the solid line indicate correlations between the electric current and the voltage at a lower limit of resistance and an upper limit of resistance, respectively.

As described above, in a state in which the temperature of the resistive heat generators 361 to 368 increases in a certain degree, the temperature of the resistive heat generators 361 to 368 is stabilized. Accordingly, the correlations between the electric current and the voltage are stabilized linearly as illustrated in FIG. 5C. Consequently, an electric current value Iac that flows through the resistive heat generators 361 to 368 is detected readily with the stabilized correlations. In this case also, the electric current detector 430 preferably detects the electric current value Iac that flows through the resistive heat generators 361 to 368 before conveyance of a sheet P to the fixing device 300 starts so that the controller 400 determines whether or not abnormality occurs.

FIG. 6B illustrates steps S15 to S18 as an example of step S5 in FIG. 6A for performing detection of the electric current. Hence, steps S11 to S13 in FIG. 6B are equivalent to steps S1 to S3 depicted in FIG. 6A. In step S14, the controller 400 determines whether or not detection of failure is allowed. If the controller 400 determines that detection of failure is not allowed in step S14 (NO in step S14), the control processes finish.

If the controller 400 determines that detection of failure is allowed (YES in step S14), the controller 400 determines whether or not the electric current detector 430 detects the voltage conversion value Viac obtained by converting the electric current value Iac that flows through the resistive heat generators 361 to 368 between the electrodes 360*c* and 360*d* into a voltage and the controller 400 reads and determines the voltage conversion value Viac in step S15. In step S16, the controller 400 determines whether or not a voltage detector 450 depicted in FIG. 4 detects a voltage value Vac between the electrodes 360*c* and 360*d* and the controller 400 reads and determines the voltage value Vac.

Thereafter, in step S17, the controller 400 calculates a failure threshold electric current value Ith (e.g., the threshold voltage Vith for failure). In step S18, the controller 400 compares the voltage conversion value Viac with the threshold voltage Vith for failure. If the voltage conversion value Viac is not smaller than the threshold voltage Vith for failure (Viac≥Vith), the control processes finish.

Conversely, if the voltage conversion value Viac that is detected is smaller than the threshold voltage Vith for failure (Viac<Vith), the controller 400 determines that one of the resistive heat generators 361 to 368 suffers from failure, for example, disconnection. Accordingly, the controller 400 turns off the heater relay 440 in step S19 and causes a control panel of the laser printer 100 to display an error to notice the error to the user in step S20.

If the controller 400 interrupts supplying power while the sheet P is conveyed through the fixing device 300 and at the same time interrupts rotation of the sheet feeding roller 60 and the like, the sheet P is jammed. Conversely, if the controller 400 continues rotation of the sheet feeding roller 60 and the like, faulty fixing increases. To address those circumstances, the controller 400 preferably notices the error to the user and continues rotation of the sheet feeding roller 60 and the like unless disconnection of a part of the resistive heat generators 361 and 368 adversely affects substantially, for example, to safety, printing upon reception by facsimile, and the like.

The voltage detector 450 detects the voltage value Vac between the electrodes 360*c* and 360*d* separately because the voltage value Vac applied between the electrodes 360*c* and 360*d* substantially affects the electric current value Iac that flows between the electrodes 360*c* and 360*d* as illustrated in FIG. 5B. Hence, the controller 400 corrects the failure threshold electric current value Ith (e.g., the threshold voltage Vith for failure) depending on an amount of the voltage value Vac that is detected.

As illustrated in the dotted lines indicating the lower limit of resistance and the upper limit of resistance in FIG. 5C, a total resistance value between the electrodes 360*c* and 360*d* connected to the resistive heat generators 361 to 368 also varies in a range of from about plus-minus 5% to about plus-minus 10% depending on variation in manufacturing of the resistive heat generators 361 to 368. To address the variation in manufacturing, the controller 400 may correct the failure threshold electric current value Ith (e.g., the threshold voltage Vith for failure) based on the voltage value Vac.

According to this embodiment, the controller 400 does not correct the failure threshold electric current value Ith (e.g., the threshold voltage Vith for failure) when an allowable variation threshold of the voltage value Vac is in a range of plus-minus 5%, for example. If the allowable variation threshold exceeds plus-minus 5%, the controller 400 corrects the failure threshold electric current value Ith (e.g., the threshold voltage Vith for failure). For example, when the controller 400 compares the voltage conversion value Viac with the threshold voltage Vith for failure in step S18 as described above, the controller 400 increases or decreases the threshold voltage Vith for failure according to a variation rate in percentage of the voltage value Vac.

FIG. 6C is a flowchart illustrating control processes to control the heater 91 with the first temperature detecting sensor TH1 and the second temperature detecting sensor TH2. As illustrated in FIG. 6C, in step S21, the laser printer 100 receives an instruction to perform a print job, thus starting the print job.

In step S22, the controller 400 causes the alternating current power supply 410 to start supplying power to each of the resistive heat generators 361 to 368 of the heat generator 360. In step S23, the first temperature detecting sensor TH1 serving as the first temperature sensor detects the temperature $T_4$ of the resistive heat generator 364 situated in a center span of the heat generator 360 in the longitudinal direction thereof as illustrated in FIG. 4.

Subsequently, in step S24, the controller 400 controls the triac 420 to start adjusting the temperature of the heat generator 360. In step S25, the second temperature detecting sensor TH2 serving as the second temperature sensor detects the temperature $T_8$ of the resistive heat generator 368.

In step S26, the controller 400 determines whether or not the temperature $T_8$ is a predetermined temperature TN or higher. If the controller 400 determines that the temperature $T_8$ is lower than the predetermined temperature TN, the controller 400 determines that an abnormally decreased temperature (e.g., disconnection) occurs and controls the triac 420 to practically interrupt supplying power to the heat generator 360 in step S27. In step S28, the controller 400 causes the control panel of the laser printer 100 to display an error. If the controller 400 determines that the temperature $T_8$ detected by the second temperature detecting sensor TH2 is an abnormally increased temperature also, the controller 400 may control the triac 420 to interrupt supplying power to the heat generator 360 similarly.

If the controller 400 determines that the temperature $T_8$ is the predetermined temperature TN or higher, the controller 400 determines that no abnormally decreased temperature occurs and starts printing in step S29. As described above, in addition to the control processes performed with the electric current detector 430, which are illustrated in the flowcharts depicted in FIGS. 6A and 6B, the controller 400 performs the control processes performed with the second temperature detecting sensor TH2, which are illustrated in the flowchart depicted in FIG. 6C, improving safety of the heater 91 and the fixing device 300.

The technology of the present disclosure is described according to the embodiments described above. However, the technology of the present disclosure is not limited to the embodiments described above and is modified within the scope of the present disclosure. For example, the heater 91 is applied to apparatuses and devices other than the fixing device (e.g., the fixing devices 300, 300S, 300T, and 300U), such as a dryer. The resistive heat generators (e.g., the resistive heat generators 361 to 368) may overlap each other with an engagement or the like such as a combination of a projection and a depression and teeth of a comb, other than overlapping illustrated in FIGS. 3B, 3C, 3E, 3F, 3H, 3I, 3K, and 3L. The number of the resistive heat generators may be smaller or greater than eight. The resistive heat generators may be arranged in a plurality of columns in the short direction of the base 350.

A description is provided of advantages of the heater 91.

As illustrated in FIG. 4, a heater (e.g., the heater 91) includes a base (e.g., the base 350), a plurality of resistive heat generators (e.g., the resistive heat generators 361 to 368), a power supply (e.g., the alternating current power supply 410), an electric current detector (e.g., the electric current detector 430), a voltage detector (e.g., the voltage detector 450), and an electric current controller (e.g., the controller 400). The plurality of resistive heat generators is electrically connected to each other in parallel in a longitudinal direction of the base. The power supply supplies power to the resistive heat generators. The electric current detector detects an electric current that flows through the resistive heat generators. The voltage detector detects a voltage applied to the resistive heat generators. The electric current controller controls the electric current that flows through the resistive heat generators based on the electric current detected by the electric current detector and the voltage detected by the voltage detector. The electric current detector detects the electric current in a state in which, after the power supply starts supplying the power to the resistive heat generators, a waveform of an alternating current supplied to the resistive heat generators remains constant for a predetermined time period or longer taken for the electric current detector to detect the electric current.

According to the embodiments described above, the electric current detector detects the electric current in the state in which, after the power supply starts supplying the power to the resistive heat generators, the waveform of the alternating current supplied to the resistive heat generators remains constant for the predetermined time period or longer taken to detect the electric current and the voltage. Accordingly, the electric current detector detects change in resistance (e.g., change in the electric current) of the resistive heat generators precisely.

According to the embodiments described above, the fixing belt 310 serves as a tubular belt. Alternatively, a fixing film, a fixing sleeve, or the like may be used as a tubular belt. Further, the pressure roller 320 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A heater comprising:

a base;

a plurality of resistive heat generators electrically connected to each other in parallel in a longitudinal direction of the base;

a power supply to supply power to the resistive heat generators;

an electric current detector to detect an electric current that flows through the resistive heat generators;

a voltage detector to detect a voltage applied to the resistive heat generators; and an electric current controller to control the electric current that flows through the resistive heat generators based on the electric current detected by the electric current detector and the voltage detected by the voltage detector, the electric current detector being configured to detect the electric current in a state in which, after the power supply starts supplying the power to the resistive heat generators, a waveform of an alternating current supplied to the resistive heat generators remains constant for a predetermined time period or longer for the electric current detector to detect the electric current, wherein the waveform defines a turning-on state in which the alternating current is created in an ON section of operation, and the resistive heat generators have a positive temperature coefficient, wherein the heater further comprises a temperature detecting sensor to detect a temperature of at least one of the resistive heat generators, and the electric current controller controls the alternating current supplied to the resistive heat generators by a phase control based on the temperature detected by the temperature detecting sensor, and wherein the electric current detector detects the electric current before the phase control.

2. A heater comprising:

a base;

a plurality of resistive heat generators electrically connected to each other in parallel in a longitudinal direction of the base;

a power supply to supply power to the resistive heat generators;

an electric current detector to detect an electric current that flows through the resistive heat generators;

a voltage detector to detect a voltage applied to the resistive heat generators; and an electric current controller to control the electric current that flows through the resistive heat generators based on the electric current detected by the electric current detector and the voltage detected by the voltage detector, the electric current detector being configured to detect the electric current in a state in which, after the power supply starts supplying the power to the resistive heat generators, a waveform of an alternating current supplied to the resistive heat generators remains constant for a predetermined time period or longer for the electric current detector to detect the electric current, wherein the waveform defines a turning-on state in which the alternating current is created in an ON section of operation, and the resistive heat generators have a positive temperature coefficient, wherein the electric current controller interrupts the electric current that flows through the resistive heat generators when the electric current detected by the electric current detector is smaller than a predetermined threshold electric current.

3. The heater according to claim 2, wherein the electric current controller corrects the predetermined threshold electric current based on the voltage detected by the voltage detector.

4. A fixing device comprising:

a tubular belt that is rotatable;

a pressure rotator to contact the tubular belt, at least one of the tubular belt and the pressure rotator to define a fixing nip through which a recording medium bearing an image formed with a developer is conveyed; and a heater to heat the tubular belt from which heat is conducted to the fixing nip, the heater including:

a base;

a plurality of resistive heat generators electrically connected to each other in parallel in a longitudinal direction of the base;

a power supply to supply power to the resistive heat generators;

an electric current detector to detect an electric current that flows through the resistive heat generators;

a voltage detector to detect a voltage applied to the resistive heat generators; and an electric current controller to control the electric current that flows through the resistive heat generators based on the electric current detected by the electric current detector and the voltage detected by the voltage detector, the electric current detector to detect the electric current in a state in which, after the power supply starts supplying the power to the resistive heat generators, a waveform of an alternating current supplied to the resistive heat generators remains constant for a predetermined time period or longer for the electric current detector to detect the electric current, wherein the waveform defines a turning-on state in which the alternating current is created in an ON section of operation, and the resistive heat generators have a positive temperature coefficient, wherein, when the electric current detected by the electric current detector is smaller than a predetermined threshold electric current, the electric current controller interrupts the electric current that flows through the resistive heat generators before the recording medium passes through the fixing nip.

5. The fixing device according to claim 4, wherein the heater is disposed inside a loop formed by the tubular belt, and wherein the heater and the pressure rotator sandwich the tubular belt at the fixing nip.

6. The fixing device according to claim 4, further comprising a nip former to press against the pressure rotator to form the fixing nip.

7. The fixing device according to claim 6, wherein the nip former presses against the pressure rotator via the tubular belt.

8. The fixing device according to claim 6, wherein heat is conducted from the tubular belt to the fixing nip through the pressure rotator.

9. An image forming apparatus comprising:

an image forming device to form an image with a developer; and a fixing device to fix the image on a recording medium, the fixing device including:

a tubular belt that is rotatable;

a pressure rotator to contact the tubular belt, at least one of the tubular belt and the pressure rotator to define a fixing nip through which the recording medium bearing the image is conveyed; and a heater to heat the tubular belt from which heat is conducted to the fixing nip, the heater including:

a base;

a plurality of resistive heat generators electrically connected to each other in parallel in a longitudinal direction of the base;

a power supply to supply power to the resistive heat generators;

an electric current detector to detect an electric current that flows through the resistive heat generators;

a voltage detector to detect a voltage applied to the resistive heat generators; and an electric current controller to control the electric current that flows through the resistive heat generators based on the electric current detected by the electric current detector and the voltage detected by the voltage detector, the electric current detector to detect the electric current in a state in which, after the power supply starts supplying the power to the resistive heat generators, a waveform of an alternating current supplied to the resistive heat generators remains constant for a predetermined time period or longer for the electric current detector to detect the electric current, wherein the waveform defines a turning-on state in which the alternating current is created in an ON section of operation, and the resistive heat generators have a positive temperature coefficient, wherein the heater further comprises a temperature detecting sensor to detect a temperature of at least one of the resistive heat generators, and the electric current controller controls the alternating current supplied to the resistive heat generators by a phase control based on the temperature detected by the temperature detecting sensor, and wherein the electric current detector detects the electric current before the phase control.

* * * * *